US008843051B2

(12) United States Patent
Udagawa

(10) Patent No.: US 8,843,051 B2
(45) Date of Patent: Sep. 23, 2014

(54) MEDIUM CONTAINING CASSETTE, MEDIUM FEEDING UNIT, OPTIONAL MEDIUM FEEDING UNIT AND IMAGE FORMING APPARATUS

(75) Inventor: Hiroshi Udagawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 788 days.

(21) Appl. No.: 12/582,845

(22) Filed: Oct. 21, 2009

(65) Prior Publication Data

US 2010/0104338 A1 Apr. 29, 2010

(30) Foreign Application Priority Data

Oct. 24, 2008 (JP) ..... 2008-274935

(51) Int. Cl.
*G03G 15/00* (2006.01)
*B65H 1/08* (2006.01)
*B65H 1/12* (2006.01)

(52) U.S. Cl.
CPC ..... *G03G 15/6511* (2013.01); *G03G 2215/004* (2013.01); *G03G 2215/00396* (2013.01)
USPC ..... 399/393; 271/126; 271/127; 271/160

(58) Field of Classification Search
USPC ..... 399/388, 393, 43, 66, 68; 271/126, 160
See application file for complete search history.

(56) References Cited

U.S. PATENT DOCUMENTS

| | | | | |
|---|---|---|---|---|
| 5,201,873 | A * | 4/1993 | Kikuchi et al. | 271/9.13 |
| 6,585,254 | B2 * | 7/2003 | Hsieh | 271/127 |
| 6,708,971 | B1 * | 3/2004 | Sasaki et al. | 271/117 |
| 7,396,174 | B2 * | 7/2008 | Hattori | 400/624 |
| 7,441,767 | B2 * | 10/2008 | Saito | 271/147 |
| 7,467,791 | B2 * | 12/2008 | Matsushima | 271/126 |
| 7,984,901 | B2 * | 7/2011 | Ohno et al. | 271/145 |
| 8,010,035 | B2 * | 8/2011 | Furushige | 399/393 |
| 8,136,808 | B2 * | 3/2012 | Kimura et al. | 271/161 |
| 2003/0116906 | A1 * | 6/2003 | Amamoto | 271/126 |
| 2005/0087921 | A1 * | 4/2005 | Aoki et al. | 271/126 |
| 2006/0034633 | A1 * | 2/2006 | Tsusaka et al. | 399/107 |
| 2008/0128974 | A1 * | 6/2008 | Murakami et al. | 271/127 |

FOREIGN PATENT DOCUMENTS

| | | | |
|---|---|---|---|
| JP | H04-019527 | U | 2/1992 |
| JP | H08-073053 | A | 3/1996 |
| JP | 08-324804 | A | 12/1996 |
| JP | H09-183526 | A | 7/1997 |
| JP | 2002-179260 | A | 6/2002 |

* cited by examiner

*Primary Examiner* — Matthew G Marini
*Assistant Examiner* — Justin Olamit
(74) *Attorney, Agent, or Firm* — Marvin A. Motsenbocker; MOTS Law, PLLC

(57) ABSTRACT

A medium containing cassette includes: a container case for containing media; a stack plate movable in the container case and configured to stack the media thereon; a separator provided on the container case and configured to separate the media one by one; and a bias member configured to bias the stack plate toward the media stacked on the stack plate. The bias member is disposed to have a greater distance from the stack plate than the separator, in a direction from the stack plate to the separator, on a plane substantially perpendicular to a bias direction of the bias member.

14 Claims, 19 Drawing Sheets

MEDIUM CONTAINING CASSETTE, MEDIUM FEEDING UNIT, OPTIONAL MEDIUM FEEDING UNIT AND IMAGE FORMING APPARATUS

CROSS REFERENCE TO RELATED APPLICATIONS

This application claims priority based on 35 USC 119 from prior Japanese Patent Application No. P2008-274935 filed on Oct. 24, 2008, entitled "medium containing cassette, medium feeding unit, optional medium feeding unit, and image forming apparatus", the entire contents of which are incorporated herein by reference.

BACKGROUND OF THE INVENTION

1. Field of the Invention

The invention relates to a medium containing cassette for containing recording media to be fed by a paper feeding mechanism in an image forming apparatus, a medium feeding unit incorporating the medium containing cassette, an optional medium feeding unit such as an optional tray unit incorporating the medium containing cassette and an image forming apparatus incorporating the medium containing cassette, the medium feeding unit or the optional medium feeding unit and configured to develop images according to received image data on the recording medium and output them.

2. Description of Related Art

Regarding a conventional image forming apparatus such as a copying machine, a printer, facsimile machine or electrophotographic color recording machine, a charging roller uniformly charges a photosensitive drum serving as an image carrier, an exposure unit directly exposes the photosensitive drum or indirectly exposes the photosensitive drum using a laser scanning optical system or a LED recording optical system so as to form an electrostatic latent image according to image information on the photosensitive drum, a developer supply unit supplies toner serving as a developer to a developer carrier, the developer carrier develops the electrostatic latent image to form a toner image on the photosensitive drum by supplying the toner to the photosensitive drum directly or indirectly via an intermediate transferring member, a transfer unit transfers the toner image formed on the photosensitive drum onto a recording medium serving as a printable sheet such as paper, film or the like, and then a fixing unit melts and presses the toner image transferred on the recording medium to fix the toner image on the recording medium.

Such an image forming apparatus includes a medium containing cassette which contains the recording media in a stacked manner to be fed by the medium feeding roller mechanism serving as a medium feeding mechanism of a medium conveying unit. The medium containing cassette includes, a stack plate on which the recording media are stacked, a spring attached under the stack plate serving as a bias member which biases the stack plate toward the medium feeding roller mechanism of the medium conveying unit, a separating pad opposed to the medium feeding roller mechanism of the medium conveying unit and configured to separate the stacked recording media so as to feed one recording medium at a time, side end guide members configured to line up the side ends of the stacked recording media, and a rear end guide member provided on the side opposed to the separating pad and configured to line up the rear end of the stacked recording media.

When the medium containing cassette containing the recording media is attached to the image forming apparatus, the stack plate is lifted up by the biasing force of the spring that is attached under the stack plate so that the uppermost recording medium is in press contact with the medium feeding roller of the medium feeding roller mechanism. The stacked recording media to be fed by a rotation of the medium feeding roller are separated one by one by the separating pad and then conveyed downstream of the recording medium conveying path (for example, Japanese Patent Application Laid-Open No. H08-324804).

In the described configuration, the medium containing cassette needs to have a certain height that is the sum of the height of the stack of recording media, the thickness of the stack plate on which the stack of recording media is placed, the height of the compressed spring that biases the stack plate, and the height of a spring seating portion of the bottom of the medium containing cassette having enough strength to tolerate the compression bias force of the spring.

SUMMARY OF THE INVENTION

A first aspect of the invention is a medium containing cassette including: a container case for containing media; a stack plate movable in the container case and configured to stack the media thereon; a separator provided on the container case and configured to separate the media one by one; and a bias member configured to bias the stack plate toward the media stacked on the stack plate, wherein the bias member is disposed to have a greater distance from the stack plate than the separator, in a direction from the stack plate to the separator, on a plane substantially perpendicular to a bias direction of the bias member.

A second aspect of the invention is a medium containing cassette including: a container case that includes a container portion defining therein a medium stacking space to contain a stack of media; a stack plate movable in a medium stacking space and configured to stack the stack of media thereon; a bias member configured to bias the stack plate and disposed in the container but out of container portion.

A third aspect of the invention is a medium containing cassette including: a container case including a medium stacking space to contain a stack of media and a separator supporting portion provided at a downstream position from the medium stacking space in a feeding direction of the medium; a stack plate movable in a medium stacking space and configured to stack the stack of media thereon; a separator supported by the separator supporting portion of the container case and configured to separate the media one by one; and a bias member configured to bias the stack plate toward the stack of media stacked on the stack plate, wherein the bias member is disposed inside the separator supporting portion.

A fourth aspect of the invention is a medium containing cassette including: a container case including a medium stacking space to contain a stack of media and a handle configured to be grabbed to draw the container case; a stack plate movable in the medium stacking space and configured to stack the stack of media thereon; a bias member configured to bias the stack plate toward the stack of media stacked on the stack plate, wherein the bias member is disposed inside the handle portion.

According to the aspects of the invention, the height of the medium containing cassette can be much smaller, thereby allowing the image forming apparatus incorporating the medium containing cassette to be much smaller.

DETAILED DESCRIPTION OF EMBODIMENTS

Figure 1:
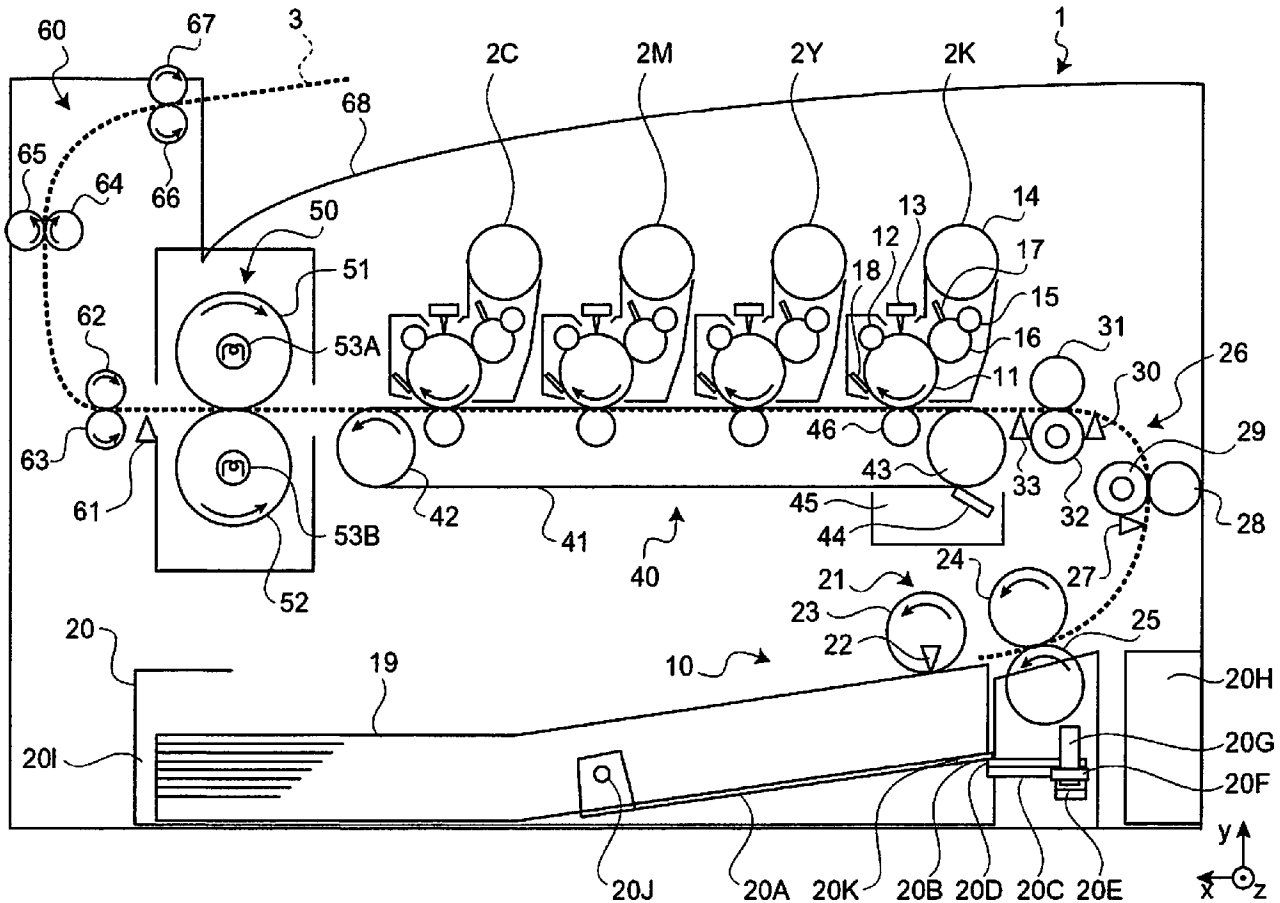
FIG. 1 is a block diagram of an image forming apparatus according of a first embodiment.

Descriptions are provided herein below for embodiments based on the drawings. In the respective drawings referenced herein, the same constituents are designated by the same reference numerals and duplicate explanation concerning the same constituents is basically omitted. All of the drawings are provided to illustrate the respective examples only.

Hereinafter, a medium containing cassette, a medium feeding unit, an optional medium feeding unit and an image forming apparatus according to preferable embodiments are described with reference to the drawings. Note that the invention regarding a medium containing cassette, a medium feeding unit, an optional medium feeding unit, and an image forming apparatus is not limited to embodiments described below and covers other embodiments and modifications without departing from the scope of the invention.

[First Embodiment]

First, image forming apparatus 1 of a first embodiment will be described. FIG. 1 is a block diagram of image forming apparatus 1. Image forming apparatus 1 includes medium conveying path 3 configured to convey recoding media 19, and image forming units 2K, 2Y, 2M and 2C provided along medium conveying path 3 and configured to form respective toner images of black, yellow, magenta and cyan according to image information. Medium conveying path 3 is formed in a substantially S-shape and extends from medium containing cassette 20 for containing the stack of recording media 19 to stacker 68 to which printed recording media 19 are discharged.

Image forming units 2K, 2Y, 2M and 2C provided in image forming apparatus 1 will now be described. Image forming units 2K, 2Y, 2M and 2C are detachably attached to the body of image forming apparatus 1 and are disposed sequentially in the medium conveying direction along medium conveying path 3. Note that image forming units 2K, 2Y, 2M and 2C have the same or similar configuration, and thus will be denoted by a reference numeral "2" herein below. Image forming unit 2 includes photosensitive drum 11 configured to carry an electrostatic latent image according to image information, charging roller 12 configured to charge the surface of photosensitive drum 11, exposure unit 13 configured to emit light according to the image information onto the surface of photosensitive drum 11, toner container 14 configured to contain toner serving as a developer, toner supplying roller 15 configured to supply the toner to developing roller 16, developing roller 16 configured to supply the toner to the surface of photosensitive drum 11 to develop the electrostatic latent image so as to form a toner image, development blade 17 configured to form a thin toner layer of uniform thickness on developing roller 14, and cleaning blade 18 configured to remove untransformed toner remaining on photosensitive drum 11. Note that image forming unit 2 is detachably attached to the body of image forming apparatus 1, whereas exposure unit 13 of image forming unit 2 is fixed to the body of image forming apparatus 1. Next, these components of image forming unit 2 will be described with reference to FIG. 1.

Photosensitive drum 11 serves a image carrier to carry a developer image. Photosensitive drum 11 is configured to retain electrical charge on the surface thereof to carry the electrostatic latent image corresponding to image information. Note that photosensitive drum 11 is cylindrical and rotatable. Such a photosensitive drum 11 is formed with a conductive base layer made of aluminum and the like and a photosensitive layer that is formed of a charge generation layer and a charge transport layer. Charging roller 12 is configured to uniformly apply positive charge or negative charge of a predetermined level to the surface of photosensitive drum 11 using an electric source (not shown). Charging roller 12 is rotatable while being in pressure-contact with the surface of photosensitive drum 11. Charging roller 12 is made of a conductive metal shaft coated by a semiconductive elastic rubber such as silicon or the like. Exposure unit 13 is provided above photosensitive drum 11 in the body of image forming apparatus 1, such that exposure unit 13 can radiate light corresponding to the image information to the surface of photosensitive drum 11 to form the electrostatic latent image on the surface of photosensitive drum 11. Such an exposure unit 13 may be formed of an assembly of plural LED elements, a lens array and a LED driving element. Toner container 14 contains toner serving as a developer and is attached above toner supplying roller 15. Note that toner container 14 is, for example, formed in a substantially circle shape as seen from a direction perpendicular to the recording medium conveying direction and formed in rectangular shape extending in the direction perpendicular to the recording medium conveying direction. Toner container 14 is detachably attached to the body of image forming apparatus 1 in order to be replaced upon running out of the toner in the printing operation.

Toner supplying roller 15 is configured to rotate while being in contact with developing roller 16, to supply toner to developing roller 16. Toner supplying roller 15 is, for example, made of a conductive metal shaft coated with a rubber including a foaming agent. Developing roller 16 is configured to rotate while being in contact with the surface of photosensitive drum 11. Developing roller 16 transfers toner to photosensitive drum 11, so as to develop the electrostatic latent image formed on the surface of photosensitive drum 11 to form a toner image. Developing roller 16 is, for example, formed in a cylindrical drum shape and made of a conductive metal shaft coated with a semiconductive polyurethane rubber or the like. Development blade 17 is disposed such that its tip contacts the surface of developing roller 16. Development blade 17 scraps excessive toner supplied from toner supplying roller 15 from developing roller 16 to form a uniform toner layer on the surface of developing roller 16. Development blade 17 is, for example, a flexible plate member made of stainless steel or the like. Cleaning blade 18 is, for example, a plate member made of a rubber or the like. Cleaning blade 18 is disposed such that its tip contacts the surface of photosensitive drum 11 in order to scrape toner that remains on the photosensitive drum 11 after the toner image on the photosensitive drum 11 is transferred to recording medium 19.

Next, medium conveying path 3 provided in the body of image forming apparatus 1 will be described. Medium conveying path 3 is a path extending from medium containing cassette 20 to stacker 68, through medium feeding unit 21, medium conveying unit 26, transferring unit 40, fixing unit 50 and discharging unit 60. Medium containing cassette 20, which is the start point of medium conveying path 3, contains recording media 19 to be fed and printed. Printed recording media are discharged to stacker 68, which is the end point of medium conveying path 3. Next, the components disposed along medium conveying path 3 will be described in detail with reference to FIG. 1.

Medium containing cassette 20 contains recording media 19 and is detachably attached to the body of image forming apparatus 1. Upon starting a print operation, recording media 19 are fed to medium conveying path 3. Recording media 19 are sheets of predetermined size onto which monochrome or color images will be transferred. Recording media 19 are generally paper such as a recycled paper, a glossy paper or a high quality paper, or transparency film used for overhead projection. Medium containing cassette 20 will be described in detail later with reference to FIGS. 1 to 16.

Medium feeding unit 21 includes lift movement detector 22, pickup roller 23, feed roller 24 and retard roller 25. Retard roller 25 is attached to medium containing cassette 20. Lift movement detector 22 is disposed above medium containing cassette 20 and in the vicinity of pickup roller 23. Lift movement detector 22 detects recording media 19 when the stack of recording media 19 in medium containing cassette 20 is lifted up and contacts with pickup roller 23. When lift movement detector 22 detects recording media 19, pickup roller 23 rotates. Pickup roller 23 is driven by a feed motor (not shown) as the stack of recording media 19 in medium containing cassette 20 is in pressure-contact with pickup roller 23. With this operation, pickup roller 23 picks up the topmost recording medium that contacts with pickup roller 23 and conveys it from medium containing cassette 20 to feed roller 24 and retard roller 25. Feed roller 24, serving as a medium feeding roller, and retard roller 25, serving as a separating member or a separating roller, are opposed to each other such that recording medium 19 that has been transported from pickup roller 23 is sandwiched there between. Note that feed roller 24 rotates when feed motor 87 connected with a planetary gear mechanism (not shown) is driven in a normal direction. When feed roller 24 rotates, recording media 19 are transported to medium conveying unit 26 one by one. Retard roller 25 is attached to medium containing cassette 20 with its rotational shaft provided in medium containing cassette 20. Retard roller 25 includes a torque limiter (not shown) that prevents retard roller 25 from rotating under a predetermined torque (not shown), so as to prevent double feeding of recording media 19 to medium conveying unit 26.

Note that medium feeding unit 10 incorporates medium containing cassette 20 therein and further comprises pickup roller 23, feed roller 24, retard roller 25 and feed motor 87. Medium feeding unit 10 supplies recording media 19 to medium conveying unit 26 in response to controller 80, in synchronization with the timing of conveying recording medium by medium conveying unit 26 and the timing of forming toner image by image forming unit 2.

Medium conveying unit 26 includes medium sensor 27, pressure roller 28, resist roller 29, medium sensor 30, pressure roller 31, convey roller 32 and write sensor 33. Next, these components will be described. Medium sensor 27 detects recording medium 19 that has been fed from medium feeding unit 21. When medium sensor 27 detects recording medium 19, feed motor 87 connected with the planetary gear mechanism (not shown) is driven in a normal rotational direction to rotate resist roller 29 at a predetermined time. Pressure roller 28 is opposed to and pressed against resist roller 29 such that, when resist roller 29 is driven to rotate with pressure roller 28, these rollers 28 and 29 sandwich there between recording medium 19 that has been fed from medium feeding unit 21 and thereby conveys recording medium 19 toward pressure roller 31 and convey roller 32. Note that resist roller 29 and pressure roller 28 correct any skew of recording medium 19, by making recording medium 19 abutt against a nip that is a contact between pressure roller 28 and resist roller 29. Convey roller 32 is driven to rotate, when medium sensor 27 detects recording medium 19.

Pressure roller 31 is opposed to and pressed against convey roller 32 such that, when convey roller 32 is driven to rotate with pressure roller 31, these rollers 31 and 32 sandwiche there between recording medium 19 that has been transported from pressure roller 28 and resist roller 29 and thereby convey recording medium 19 toward transferring unit 40. In transferring unit 40, the recording medium is transported by transfer belt 41 while recording medium 19 is electrostatically adherred to transfer belt 41. When write sensor 33 detects recording medium 19 that has been transported from pressure roller 31 and convey roller 32, transfer belt 41 is driven. Medium sensor 30 detects whether or not recording medium 19 that has been transported from pressure roller 28 and resist roller 29 is correctly transferred. Note that convey roller 32 may be used as a resist roller. If convey roller 32 is used as a resist roller, when medium sensor 30 detects recording medium 19, feed motor 87 starts to rotate convey roller 32.

Transferring unit 40 includes transfer belt 41, drive roller 42, tension roller 43, transfer belt cleaning blade 44, waste toner box 45, and transfer roller 46. Next, these components will be described. Transfer belt 41 serves as a conveyer for conveying recording medium 19 through image forming unit 2 and developing image information on recording medium 19. Transfer belt 41 is an endless belt which can carry the toner image on the circumferential surface thereof and can electrostatically adhere recording medium 19 on the circumferential surface thereof. Drive roller 42 and tension roller 43 are provided inside transfer belt 41 and provide constant tension to transfer belt 41. Drive roller 42 is formed of a member having a high frictional resistance. When drive roller 42 is driven by a drive system (not shown), tension roller 43 is rotated by the rotation of drive roller 42, so that these rollers 42 and 43 cooperatively drive transfer belt 41. Transfer belt cleaning blade 44 is in contact with the surface of transfer belt 41 at a predetermined pressure, in order to remove extraneous matter such as toner or paper powder from the surface of convey belt 41. Waste toner box 45 is a container that collects the extraneous matter removed from transfer belt by cleaning blade 44. Waste toner box 45 is disposed in the vicinity of transfer belt cleaning blade 44 and under transfer belt 41. Transfer roller 46 is disposed under photosensitive drum 11. Transfer roller 46 is disposed such that transfer roller 46 and photosensitive drum 11 sandwich recording medium 19 there between while transfer roller 46 rotates. Bias voltage having opposite polarity to that of the toner is applied to transfer 46, and thereby the toner image formed on the surface of photosensitive drum 11 is transferred onto recording medium 19. While conveying recording medium 19 that is electrostatically absorbed on transfer belt 41 along image forming units 2K, 2Y, 2M and 2C, toner images of black, yellow, magenta and cyan are transferred in register to recording medium 19, respectively.

Fixing unit 50 includes upper roller 51, lower roller 52 and heater 53. Next, these components will be described. Upper roller 51 and lower roller 52 are disposed opposite to each other such that these rollers 51 and 52 sandwich recording medium 19 conveyed from transfer belt 41. Upper roller 51 and lower roller 52 are configured to fix to recording medium 19 the toner image that is transferred on recording medium 19 by image forming unit 2. Upper roller 51 and lower roller 52 each is formed with a cylindrical drum having an elastic member on the surface thereof. Heaters 53A and 53B such as a halogen lamp or the like are provided inside upper roller 51 and lower roller 52, respectively. Upper roller 51 and lower roller 52 heat and melt the toner that is attached on recording medium 19 by weak electrostatic force using heater 53A and heater 53B and press the melted toner image to recording medium 19 so as to fix the image to recording medium 19. Note that lower roller 52 is pressed against upper roller 51 so that lower roller 52 is rotated by the rotation of upper roller 51.

Discharging unit 60 includes discharge sensor 61, discharge roller 62, driven roller 63, discharge roller 64, driven roller 65, discharge roller 66 and driven roller 67. Next these components will be described. Discharge sensor 61 detects recording medium that has been discharged from fixing unit 50. When discharge sensor 61 detects recording medium 19, discharge roller 62, discharge roller 64 and discharge roller 66 are driven to rotate by a drive system (not shown). Discharge roller 62 and driven roller 63 are disposed opposite to each other such that driven roller 63 is rotated by the rotation of discharge roller 62 while discharge roller and driven roller 63 sandwich there between image-fixed recording medium that has been discharged from fixing unit 50 so as to discharge recording medium 19 toward discharge roller 64 and driven roller 65. Discharge roller 64 and driven roller 65 are disposed opposite to each other such that driven roller 65 is rotated by the rotation of discharge roller 64 while discharge roller 64 and driven roller 65 sandwich there between image-fixed recording medium that has been discharged from discharge roller 62 and driven roller 63 so as to discharge recording medium 19 toward discharge roller 66 and driven roller 67. Discharge roller 66 and driven roller 67 are disposed opposite to each other such that driven roller 67 is rotated by the rotation of discharge roller 66 while discharge roller 66 and driven roller 67 sandwich there between image-fixed recording medium 19 that has been discharged from discharge roller 64 and driven roller 65 so as to discharge image fixed recording medium 19 toward stacker 68. Stacker 68 forms a stacking space to stack printed recording media 19 that have been discharged from discharged unit 50.

Next, medium containing cassette 20 according to the present embodiment will be described in detail with reference to FIGS. 2 to 5, in addition to FIG. 1.

Figure 2:
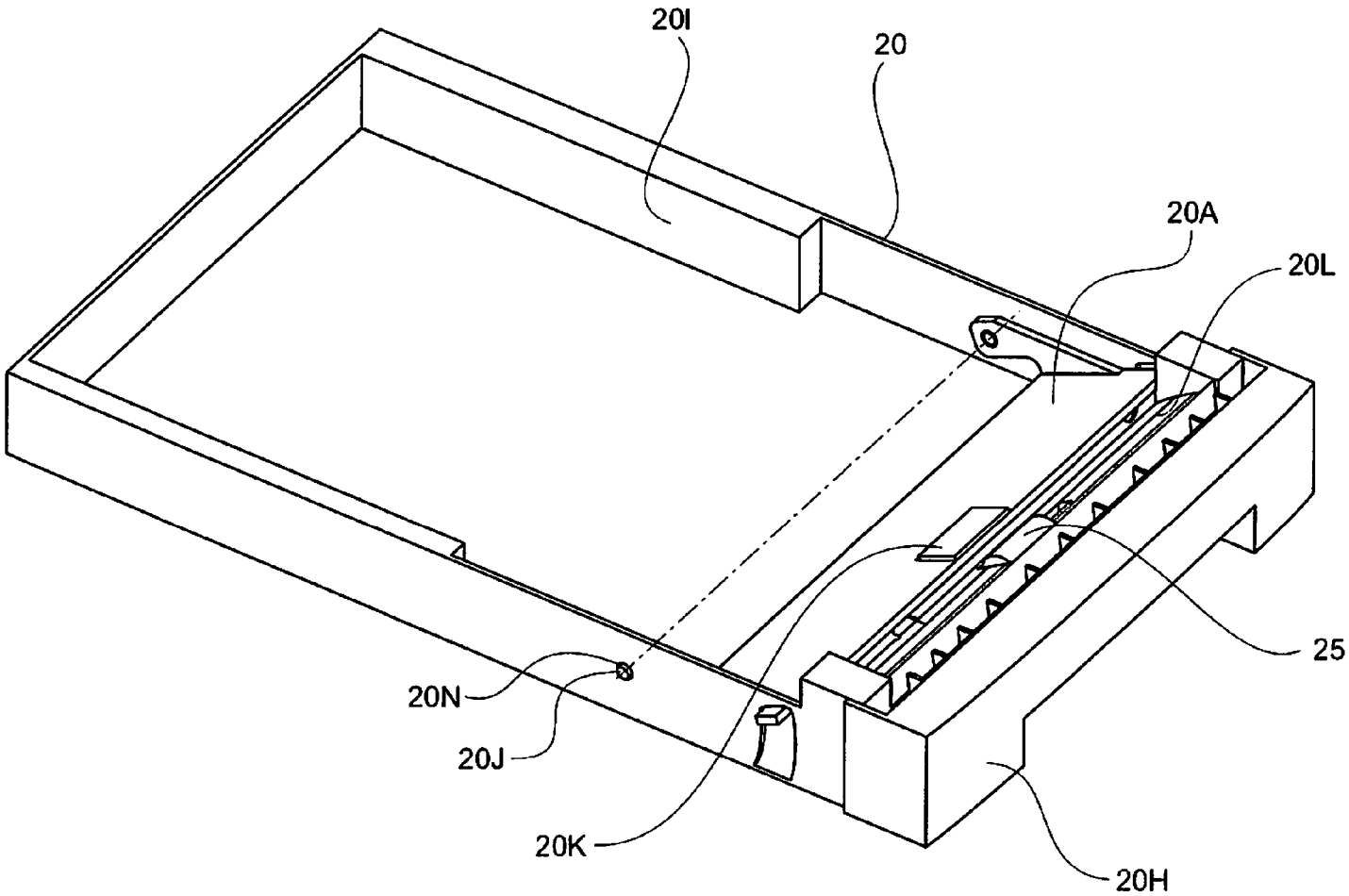
FIG. 2 is a perspective view of the medium containing cassette of the first embodiment.
Figure 3:
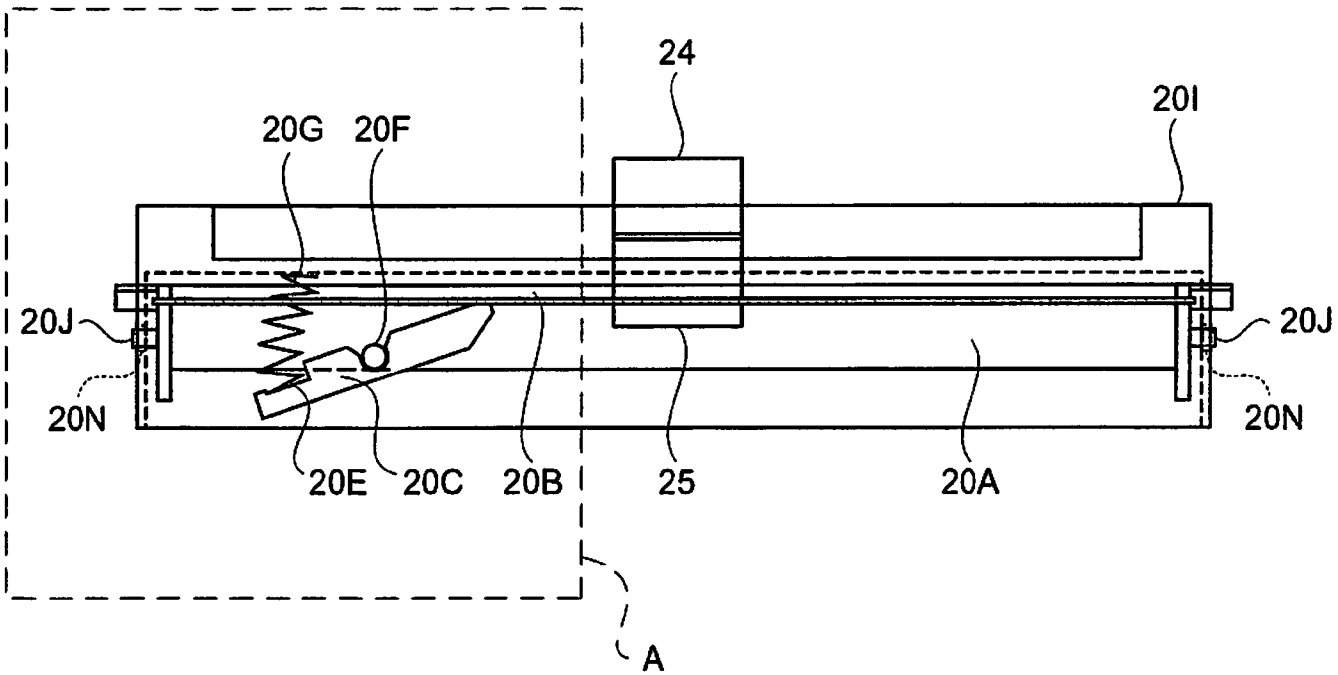
FIG. 3 is a sectional view of the medium containing cassette of the first embodiment
Figure 4:
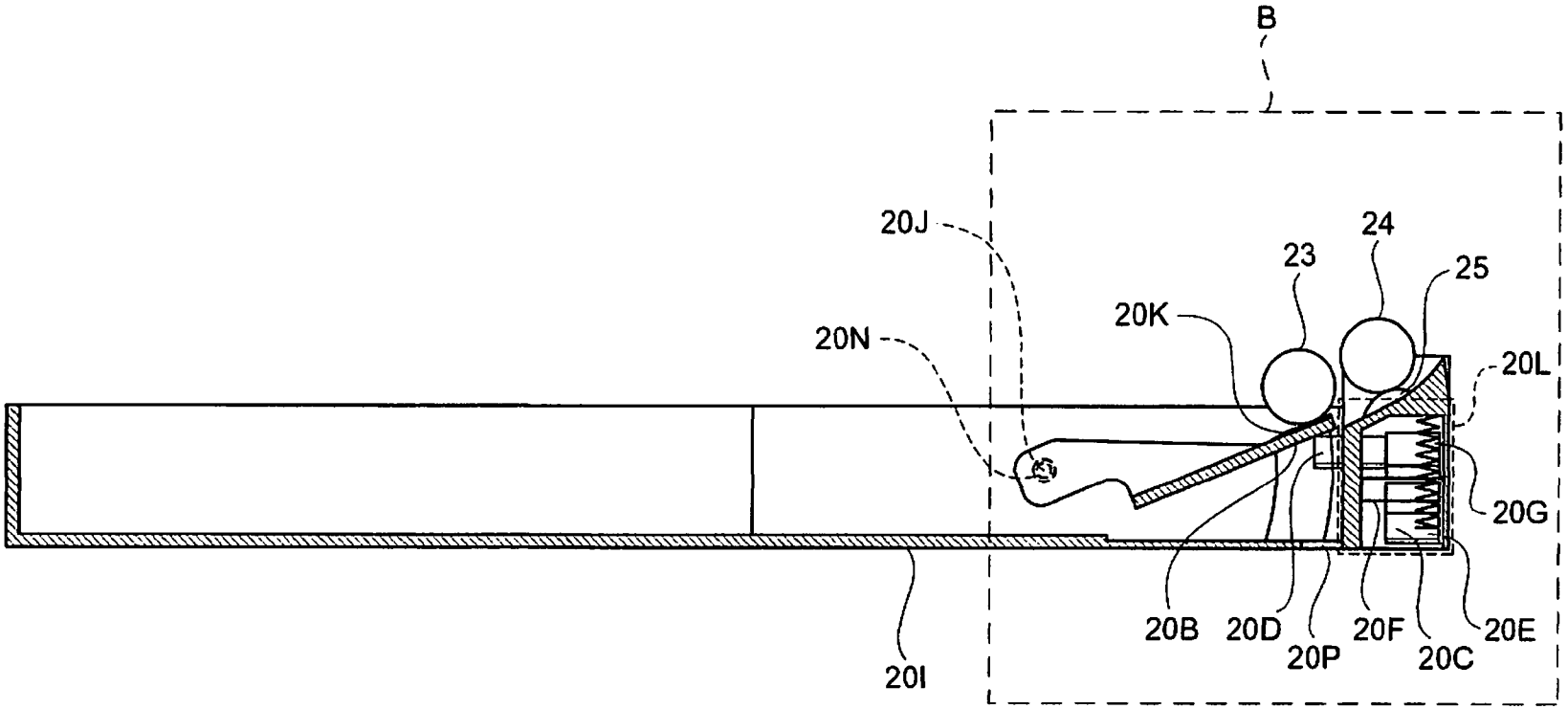
FIG. 4 is a sectional view of the medium containing cassette of the first embodiment.
Figure 5:
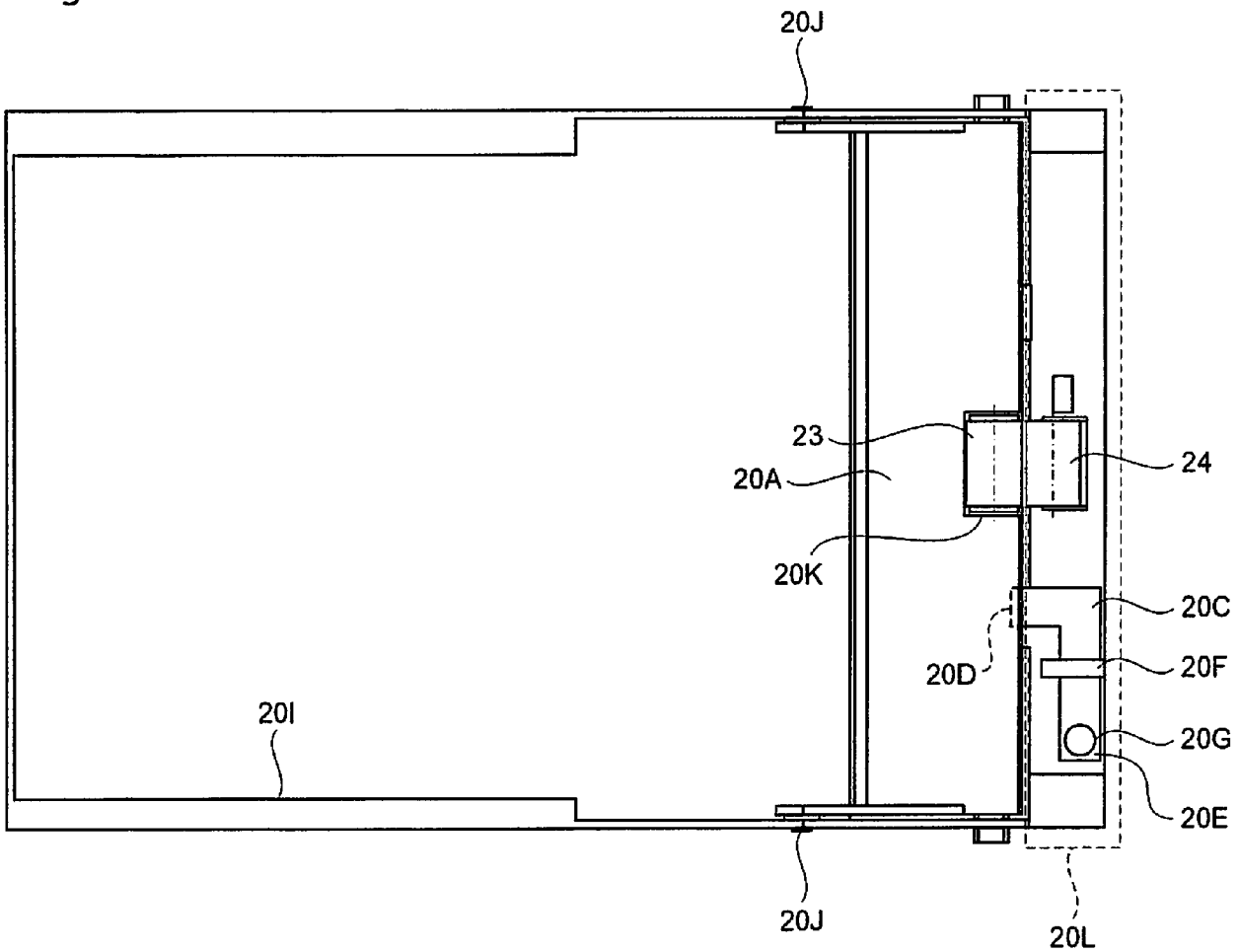
FIG. 5 is a top view of the medium containing cassette of the first embodiment.

Arrows X, Y, Z in FIG. 1 refer respectively to a direction from the front side to rear side, a direction from the bottom side to the upper side and a direction from the left side to the right side of medium containing cassette 20. FIG. 2 is a perspective view of medium containing cassette 20. FIG. 3 is a sectional view of medium containing cassette 20 as seen from the front side thereof. FIG. 4 is a sectional view of medium containing cassette 20 as seen form the left side thereof. FIG. 5 is a top view of medium containing cassette 20 as seen from the upper side thereof. Note that, in order to show a simplified positional configuration of the components of medium containing cassette 20, FIGS. 4 and 5 additionally show the positions of pickup roller 23 and feed roller 24 which are the components of medium feeding unit 21 provided in the body of image forming apparatus 1 but not the components of medium containing cassette 20 and FIGS. 4 and 5 do not show cassette cover 20H.

Medium containing cassette 20, as shown in FIG. 1, is detachably inserted in image forming apparatus 1. Medium containing cassette 20 includes container case 20I serving as the body of the medium containing cassette 20. Container case 20I is formed with a container portion defining medium stacking space therein in which recording media 19 can be stacked, and container case front portion serving as a separator supporting portion provided on the feeding side from the container portion. In the container portion of container case 20I, stack plate 20A is provided and is pivoted by support shaft 20J. The feeding side portion of the stack of recording media 19 is placed on stack plate 20A. Lift-up lever 20C is provided in container case 20I of medium containing cassette 20 and is pivoted by supporting shaft 20F parallel to axis X. One end or lift-up end 20D of L-shape lift-up lever 20C is disposed under and abuts against the feeding side portion of the bottom 20B of stack plate 20A. The other end or pull-down end 20E of lift-up lever 20C contacts with bias member 20G such as a spring such that bias member 20G pushes down push-down end 20E so that lift-up end 20D lifts up the bottom 20B while lift-up lever 20C rotates about supporting shaft 20F. When medium containing cassette 20 is not inserted in the body of image forming apparatus 1, lift-up end 20D is locked by a lift-up lever locking mechanism (not shown) at the lower end such that lift-up end 20D does not lift up bottom 20B of stack plate 20A.

When medium containing cassette 20 is inserted in the body of image forming apparatus 1, a release mechanism (not shown) provided in the body of image forming apparatus 1 releases the lift-up lever locking mechanism (not shown), and thereby lift-up lever 20C rotates. With this, lift-up end 20D of lift-up lever 20C lifts up bottom 20B of stack plate 20A so as to lift up the stack of recording media 19 placed on stack plate 20A. The lifted stack of recording media 19 abuts against pickup roller 23, and thereby, lift movement detector 22 detects recording media 19. Medium containing cassette 20 is provided with cassette cover 20H serving as a handle used for drawing medium containing cassette 20 out of the body of image forming apparatus 1. Between cassette cover 20H and container case 20I of medium containing cassette 20, an additional conveying path is formed. Recording media 19 can be transported through the additional conveying path from plural additional trays that can be attached under the body of image forming apparatus 1 in a stacked manner. The downstream of the additional conveying path is merged into a conveying path formed in the body of image forming apparatus 1.

As shown in FIG. 2, stack plate 20A is disposed at the feeding side in the containing portion of container case 20I, to place thereon the stack of recording media 19 in medium containing cassette 20. Stack plate 20A has support shaft 20J which is rotatably supported by bearing holes 20N that are formed in the side walls of container case 20I bearing holes 20N. Friction pad 20K or a separating member is formed, on the widthwise center portion of the feeding side portion of stack plate 20A. Friction pad 20*k* is configured to apply a frictional force to the lowermost recording medium 19, so as to prevent the lowermost recording medium 19 from being fed with upper recording media 19, when only several recording media 19 remains on stack plate 20A. Friction pad 20K of stack plate 20A is disposed such that the friction pad 20K is in press-contact with pickup roller 23 of medium feeding unit 21, when medium containing cassette 20 with no recording media is in the body of image forming apparatus 1 and thereby stack plate 10A rotates about support shaft 20J to be lifted to the uppermost position. Container case front portion 20L is provided on the feeding side of container case 20I. Space above the container case front portion 20L is a conveying path through which recording media 19 contained in container case 20I will be conveyed by medium feeding unit 21 or the like without interfering with container case 20I. On the widthwise center portion of container case front portion 20L, retard roller 25 serving as a separator or a separating roller is provided such that retard roller 25 is biased against feed roller 24 of medium feeding unit 21 when medium containing cassette 20 is in the body of image forming apparatus 1. Retard roller 25 is biased upward by a spring (not shown) that is disposed inside container case front portion 20L.

As shown in FIG. 4, L-shaped lift-up lever 20C serving as a subsidiary member or an intermediate member to rotate stack plate 20A and bias member 20G for rotating lift-up lever 20C are disposed inside container case front portion 20L. As shown in FIG. 3, lift-up lever 20C is rotatably supported by supporting shaft 20F as a rotational center in container case front portion 20L. One end of bias member 20G is attached to pull-down end 20E of lift-up lever 20C to apply a bias force to lift-up lever 20C such that lift-up lever 20C is rotated about supporting shaft 20F. The other end of bias member 20G is disposed at the upper portion of container case front portion 20L. Lift-up end 20D of lift-up lever 20C extends from inside container case front portion 20L toward stack plate 20A, and abuts against bottom 20B of stack plate 20A to bias lift stack plate 20A upward. Note that, as shown in FIG. 5, lift-up lever 20C and bias member 20G are disposed in container case front portion 20L such that lift-up lever 20C and bias member 20G do not overlap with retard roller 25 and other components provided at the widthwise center portion of container case front portion 20L.

As described above, according to medium containing cassette 20 of the first embodiment, bias member 20G to rotate stack plate 20A is disposed to have more distance from the container portion or stack plate 20A than pickup roller 23, feed roller 24 and retard roller 25, on a plane substantially perpendicular to a bias direction of bias member 20G. More specifically, bias member 20G is disposed at a more downstream side position in the feeding direction on the horizontal plane, than pickup roller 23, feed roller 24 and retard roller 25. In other words, the bias member 20G is disposed out of moveable area of stack plate 20A. With this structure, bias member 20G does not overlap with the conveying path for recording media 19 so as to maintain a degree of freedom of a layout for bias member 20G while the height of medium containing cassette 20 is limited. Note that, when stack plate 20A is rotated downward to contact with the bottom wall of container case 20I of medium containing cassette 20, lift-up end 20D of lift-up lever 20C moves into escape hole 20P, so that stack plate 20A can be in close contact with the bottom wall of container case 20I. Preferably, when stack plate 20A is rotated to be in close-contact with the bottom wall of container case 20I, lift-up lever 20C does not extends out of container case 20I so as not to be a projection of medium containing cassette 20. Although the bottom wall of container case 20I is formed with escape hole 20P into which lift-up end 20D of lift-up lever 20C can escape in this first embodiment, stack plate 20A may be formed with a recess into which lift-up lever 20C can escape such that stack plate 20A can be in close contact with the bottom wall of container case 20I.

Figure 6:
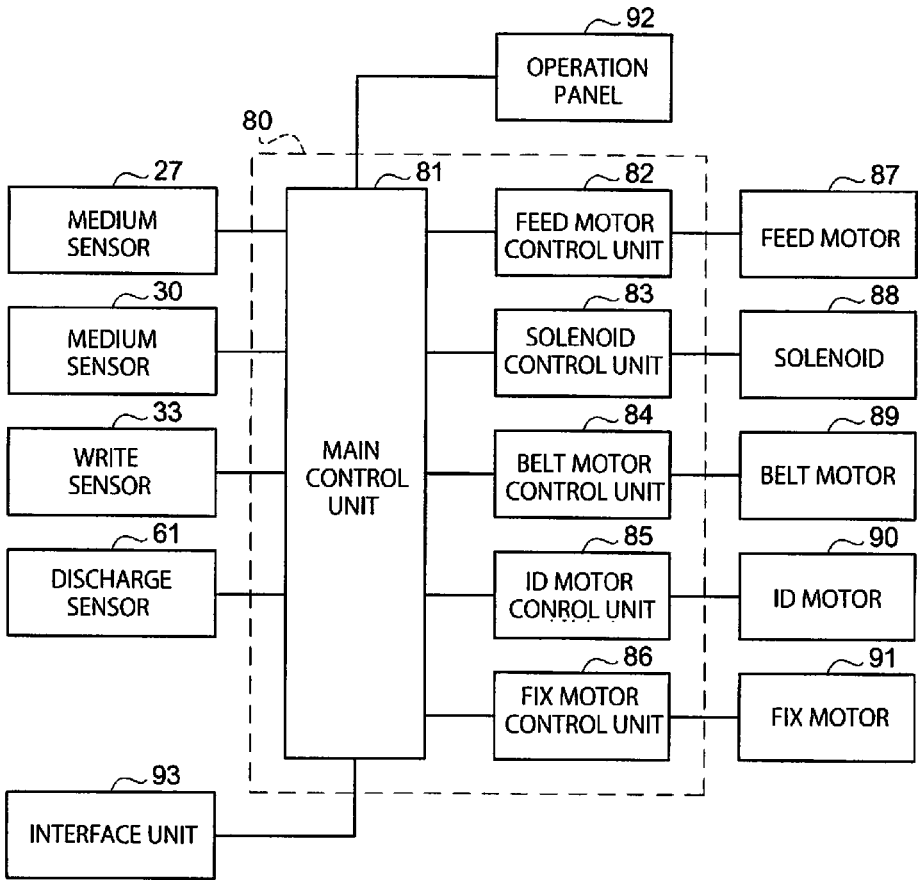
FIG. 6 is a block diagram of connections in the image forming apparatus according of a first embodiment.

Next, control of image forming apparatus 1 of the first embodiment will be described. FIG. 6 is a block diagram of the connection configuration of image forming apparatus 1. Controller 80 includes main control unit 81 provided therein and configured to output instructions to execute a sequence of processes to form image information onto recording medium 19 in image forming apparatus 1. Controller 80 includes main control unit 81 serving as a brain of controller 80, and plural control units 82 to 86 controlling the components of image forming apparatus 1. Note that main control unit 81 includes CPU serving as a controlling part and a computing part, RAM and ROM serving as program memories, a timer/counter for control timing, and the likes. Hereinafter, control units 82 to 86 which are connected to main control unit 81 and provided in controller 80 and the components which are connected to controller 80 will be described in detail with reference to FIG. 6.

Control units 82 to 86 connected to main control unit 81 and provided in controller 80 include feed motor control unit 82, solenoid control unit 83, belt motor control unit 84, ID motor control unit 85 and fixer motor control unit 86. When medium sensor 27 detects a recording medium 19 transferred from medium feeding unit 21, main control unit 81 instructs feed motor control unit 82 to send operational signals to feed motor 87 so as to control the rotation of resist roller 29. Similarly, when medium sensor 27 detects a recording medium 19, main control unit 81 instructs feed motor control unit 82 to send operational signals to feed motor 87 so as to control the rotation of convey roller 32. Main control unit 81 instructs solenoid control unit 83 to send operational signals to solenoid 88 so as to control the rotations of gears connected to drive rollers provided in image forming apparatus 1. Similarly, when medium sensor 27 detects a recording medium 19, main control unit 81 instructs belt motor control unit 84 to send operational signals to belt motor 89, so as to rotate drive roller 42 and thereby control the movement of transfer belt 41 provided in transferring unit 40. Main control unit 81 instructs ID motor control unit 85 to send operational signals to ID motor 90, so as to control the rotation of photosensitive drum 11 and the like. Main control unit 81 instructs fixer motor control unit 86 to send operational signals to fixer motor 91, so as to control the rotation of upper roller 51. When main control unit 81 instructs fixer motor 91 to operate, discharge roller 62, discharge roller 64 and discharge roller 66 are rotated by a driving system (not shown) as well.

For the above control motors, a two phase excitation pulse motor, a DC (direct-current) motor or the like is used. More specifically, when a two phase excitation pulse motor is used, the rotation speed of the motor is controlled to accelerate, keep a constant speed, decelerate or the like by applying a constant current to switch the phase current direction at each of the rising edges of clock signals or by changing the clock frequency. Similarly, when a DC motor is used, the rotation speed of the motor is controlled by increasing or decreasing a voltage value of DC (direct-current) voltage applied between the motor terminals and the rotational direction of the motor is controlled by switching the polarity of the DC voltage applied between the motor terminals. For the above solenoid, a DC (direct-current) solenoid or the like is used. When a DC solenoid is used, current is supplied to a coil of the solenoid to generate a magnetic flux to move the external mechanism which is connected to the solenoid. Concurrently a movable iron core is disposed away from a fixed iron core provided in the solenoid. When the solenoid is energized, the movable iron core is moved toward the fixed iron core quickly in an axial direction until the movable iron core is attached to the fixed iron core, by an attraction force between the movable iron core and fixed iron core so as to move the external mechanism. While current is being supplied to the coil, the movable iron core is kept attached to the fixed iron core. However, when current supply to the coil is blocked, the movable iron core is moved away to the original position by a force of the external mechanism connected to the movable iron core or a force of a restoring spring. The above configuration causes rotation of coupled gears or the like which are coupled to each drive roller.

Operation panel 92 is provided on the body of image forming apparatus 1 and includes an input unit having switches or the like (not shown) and a display unit having LED, LCD or the like (not shown). Using the input unit of image forming apparatus 1, users can change settings of a printing condition, font, type or size of recording medium. The display unit displays conditions or settings set from the input unit. Interface unit 93 includes an interface connector, IC or the like and receives image data from external apparatus (not shown) such as a host computer or personal computer and sends to main control unit 81.

Next, the operation inside medium containing cassette 20 will be described in detail. FIGS. 7 to 12 shows the operation of stack plate 20A inside medium containing cassette 20.

Figure 7:
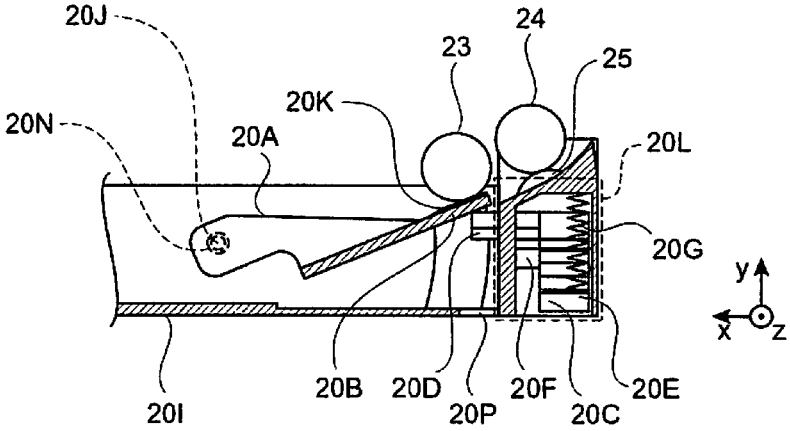
FIG. 7 is a sectional view of the medium containing cassette of the first embodiment, showing the stack plate with no recording media on the stack plate in the medium containing cassette.
Figure 8:
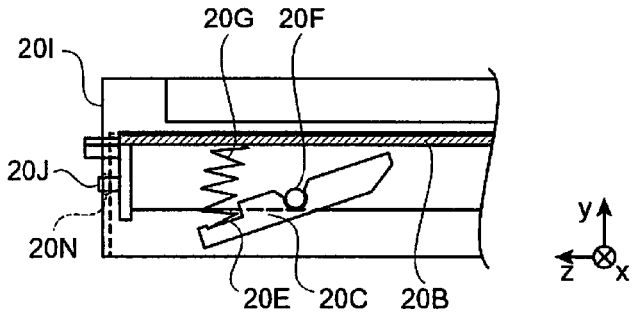
FIG. 8 is an internal sectional view of the medium containing cassette of the first embodiment, showing the stack plate with no recording media on the stack plate in the medium containing cassette.
Figure 9:
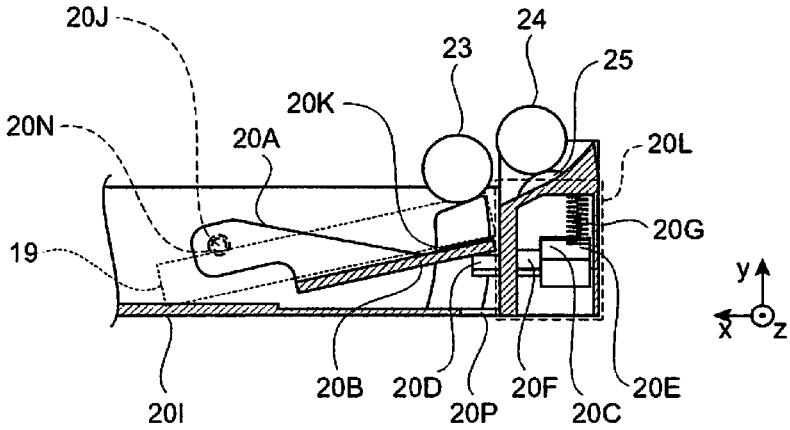
FIG. 9 is a sectional view of the medium containing cassette of the first embodiment, showing the stack plate with some recording media stacked on the stack plate in the medium containing cassette.
Figure 10:
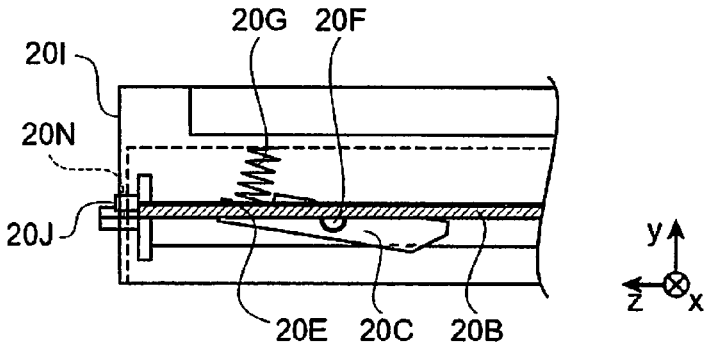
FIG. 10 is a sectional view of the medium containing cassette of the first embodiment, showing the stack plate with recording media filling the medium containing cassette.
Figure 11:
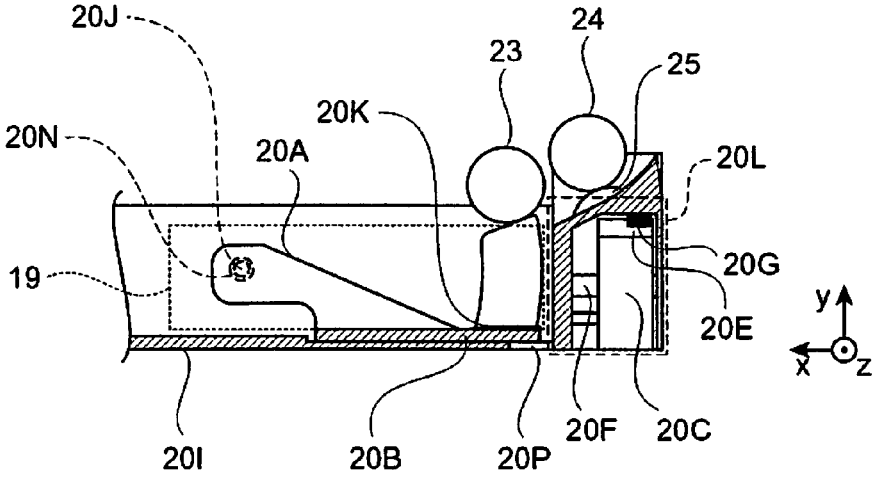
FIG. 11 is a sectional view of the medium containing cassette of the first embodiment, showing the stack plate with recording media stacked on the stack plate in the medium containing cassette to the maximum stacking capacity.
Figure 12:
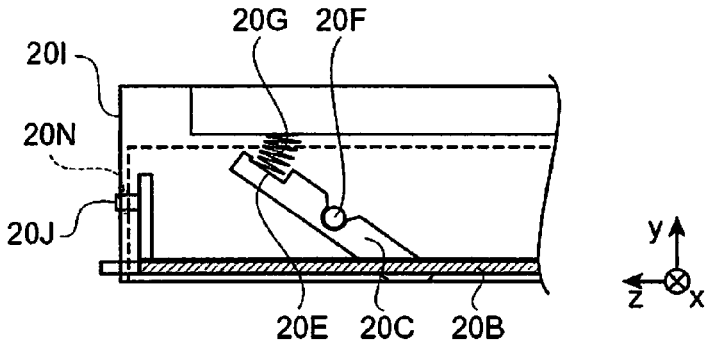
FIG. 12 is a sectional view of the medium containing cassette of the first embodiment, showing the stack plate with recording media stacked on the stack plate in the medium containing cassette to its maximum stacking capacity.

FIGS. 7 and 8 show a state where no recording media is stacked on stack plate 20A and thereby stack plate 20A is lifted up to abut against pickup roller 23. FIGS. 9 and 10 show a state where the stack of recording media 19 is stacked on stack plate 20A, nearly to half of the maximum capacity of medium containing cassette 20. FIGS. 11 and 12 show a state where the stack of recording media 19 is stacked on stack plate 20A, up to the maximum capacity of medium containing cassette 20. FIGS. 7, 9 and 11 are sectional views of medium containing cassette 20 as seen from the left side thereof, and FIGS. 8, 10 and 12 are sectional views of medium containing cassette 20 as seen from the front side thereof. Note that, in FIGS. 7 to 12, medium containing cassette 20 is attached to the body of image forming apparatus 1 having the medium feeding mechanism. First, the operation inside medium containing cassette 20 will be briefly described, and then, the operation shown in FIGS. 7 and 8, the operation shown in FIGS. 9 and 10, and the operation shown in FIGS. 11 and 12 will be described in order.

First, the operation inside medium containing cassette 20 will be briefly described. Lift-up lever 20C that is rotatably supported by supporting shaft 20F provided in container case front portion 20L is biased by bias member 20G that is provided in container case front portion 20L, so that pull-down end 20E of lift-up lever 20C is pushed down and thereby lift-up end 20D of lift-up lever 20C is lifted up, while lift-up lever 20C rotates about supporting shaft 20F parallel to the axis X. The tip of lift-up end 20D of L-shaped lift-up lever 20C abuts against bottom 20B of stack plate 20A so as to lift up stack plate 20A. With this, stack plate 20A rotates about support shaft 20J parallel to the axis Z and extending through bearing holes 20N provided the side walls of container case 20I, so that friction pad 20K provided on stack plate 20A moves toward pickup roller 23.

Next, the operation shown in FIGS. 7 and 8 will be described. FIGS. 7 and 8 shows the state where no recording media 19 are placed on stack plate 20A. In this state, lift-up lever 20C is rotated so that lift-up end 20D is lifted up, and bottom 20B of stack plate 20A is rotated about a support shaft 20J and lifted up to the point where friction pad 20K of bottom 20B abuts against pickup roller 23. In this state, pickup roller 23 can be driven to rotate, but other movements are restricted.

Next, the operation shown in FIGS. 9 and 10 will be described. FIGS. 9 and 10 show the state where the stack of recording media 19 is staked on stack plate 20A to about half of the maximum stacking capacity. In this state, lift-up lever 20C is rotated so that lift-up end 20D is lifted up, and bottom 20B of stack plate 20A is rotated about support shaft 20J and lifted up to the point where the uppermost recording medium of the stack of recording media 19 abuts against pickup roller 23. Note that the bias force of bias member 20G in this condition is set such that a pressure between the uppermost recording medium 19 and pickup roller 23 is suitable for feeding the uppermost recording medium with pickup roller 23.

Next, the operation shown FIGS. 11 and 12 will be described. FIGS. 11 and 12 show the condition where the stack of recording media 19 is staked on stack plate 20A up to the maximum stacking capacity. Similarly to FIG. 9 to FIG. 10, lift-up lever 20C is rotated so that lift-up end 20D is lifted up, and bottom 20B of stack plate 20A is rotated about support shaft 20J and lifted up to the point where the uppermost recording medium of the stack of recording media 19 abuts against pickup roller 23. Note that the bias force of bias member 20G in this condition is also set such that a pressure between the uppermost recording medium 19 and pickup roller 23 is suitable for feeding the uppermost recording medium with pickup roller 23. Lift-up end 20D of lift-up lever 20C moves into escape hole 20P formed at the bottom wall of container case 20I, and thereby bottom 20B of stack plate 20A can be in close contact the bottom wall of container case 20I smoothly.

A lift-up mechanism using lift-up lever 20C can easily modify the position where bias member 20G contacts lift-up lever 20C to change the lever ratio of lift-up lever 20C. For example, as a distance between spring 20G and supporting shaft 20F become longer, a bias force of spring 20G to lift-up can be smaller.

Note that since the lift-up operation of stack plate 20A occurs in medium containing cassette 20, recording media 19 moves toward medium feeding mechanism for feeding recording medium appropriately after medium containing cassette 20 is attached to the body of image forming apparatus 1, regardless of the amount of recording media that remains in medium containing cassette 20.

Figure 13:
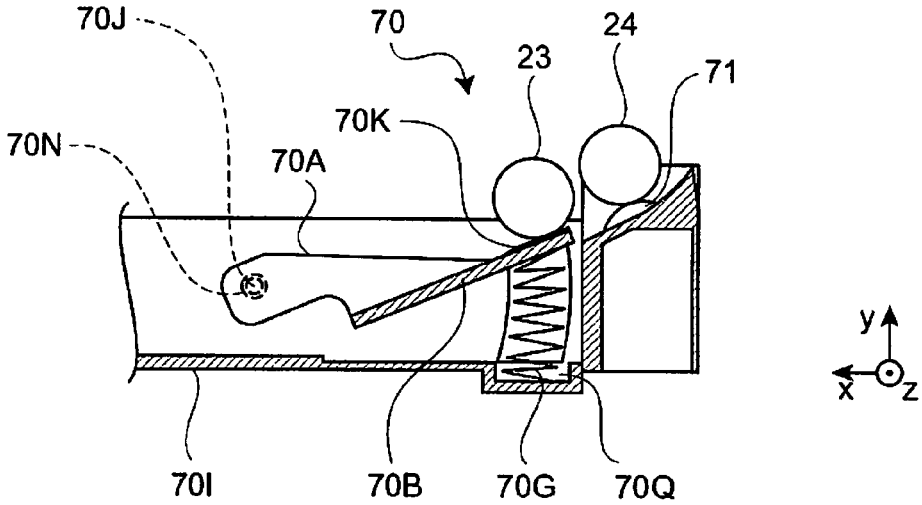
FIG. 13 is a sectional view of a comparative example of a medium containing cassette wherein a lifting mechanism that lifts a stack plate is disposed in a recording medium stackable position of the stack plate with no recording media stacked on the stack plate.
Figure 14:
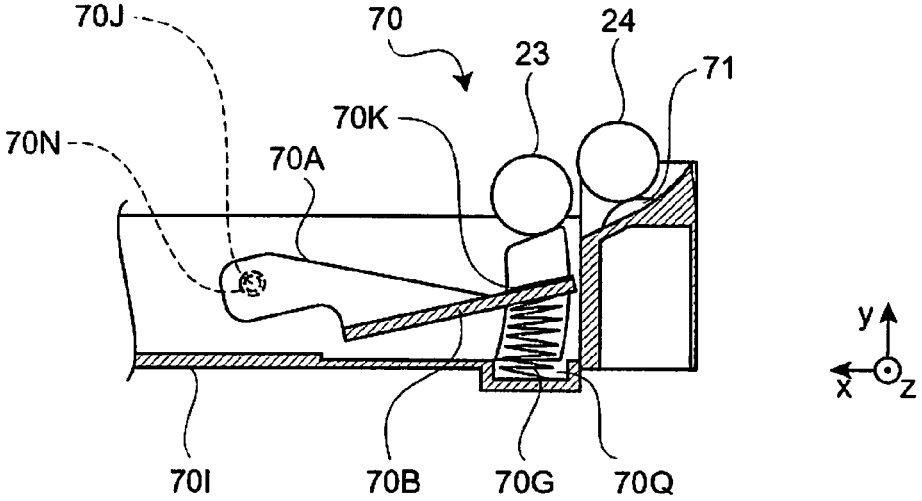
FIG. 14 is a sectional view of the comparative example of the medium containing cassette wherein the lifting mechanism is disposed in the recording medium stackable position of the stack plate with recording media stacked on the stack plate.
Figure 15:
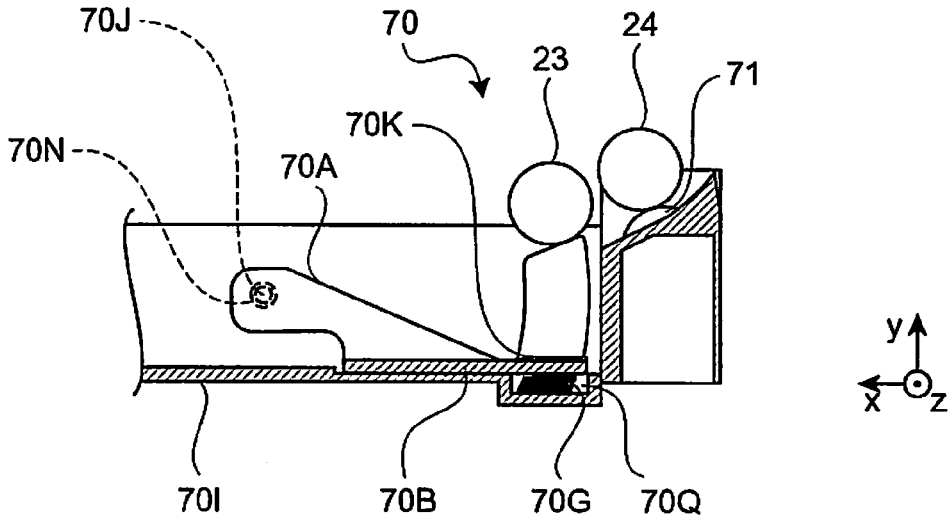
FIG. 15 is an internal sectional view of the comparative example of the medium containing cassette wherein the lifting mechanism is disposed in the recording medium stackable position of the stack plate with recording media stacked on the stack plate to its maximum stacking capacity.

Next, medium containing cassette 70 according to a comparative example wherein a lift mechanism to lift stack plate 70A is disposed in a moveable area of stack plate 70 will be described. FIGS. 13 to 15 are schematic views of medium containing cassette 70 having medium feeding mechanism in a state where medium containing cassette 70 is attached to a body of an image forming apparatus, showing the operation of stack plate 70A in medium containing cassette 70.

FIG. 13 shows a state where no recording media are stacked on stack plate 70A and thereby stack plate 70A is lifted up so as to abut against pickup roller 23. FIG. 14 shows a state where the stack of recording media 19 is stacked on stack plate 70A, nearly to half of the maximum capacity of medium containing cassette 70. FIG. 15 shows a state where the stack of recording media 19 is stacked on stack plate 70A up to the maximum capacity of medium containing cassette 70. FIGS. 13 to 15 are sectional views of medium containing cassette 70 as seen from the left side thereof. Note that, in FIGS. 13 to 15, medium containing cassette 70 is attached into the body of the image forming apparatus having the medium feeding mechanism. First, the operation inside medium containing cassette 70 will be briefly described, and then, the operation shown in FIG. 13, the operation shown in FIG. 14 and the operation shown in FIG. 15 will be described in order.

First, the configuration inside medium containing cassette 70 will be described briefly. Container case 70I configured to contain recording media 19 is provided therein with stack plate 70A for stacking recording media 19. Stack plate 70A has supporting shaft 70J extending through bearing hole 70N formed at the side walls of container case 70I, so that stack plate 70A is rotatable about supporting shaft 70J. On the bottom wall of container case 70I, bias member 70G such as a spring is for biasing stack plate 70A is provided. One end of bias member 70G is provided on the bottom wall of container case 70I, and the other end of the bias member 70G abuts against and biases bottom 70B of stack plate 70A. Retard roller 71 serving as a separating roller is provided at a front portion of container case 70I. Retard roller 71 is configured, when medium containing cassette 70 is attached to the body of image forming apparatus, and the medium feeding mechanism provided in the body of the image forming apparatus feeds recording medium 19 from medium containing cassette 70, to separate recording media 19 one by one. Friction pad 70K is provided on the front portion of stack plate 70A. Friction pad 70K contacts with the lowermost recording medium 19 of the stack and apply a frictional resistance to the lowermost recording medium so as to prevent the lowermost recording medium to being fed with the uppermost recording medium 19 when the stack of recording media on stack plate 70A become thin.

Next, the operation shown in FIG. 13 will be described. In FIG. 13, no recording media 19 are placed in medium containing cassette 70. Stack plate 70A is rotated by bias member 70G so that lift bottom 70B of the stack plate 70A is lifted up to the position where friction pad 70K provided on stack plate 70A abuts against pickup roller 23.

Next, the operation shown in FIG. 14 will be described. In FIG. 14, the stack of recording media 19 is staked on stack plate 70A nearly to half of the maximum stacking capacity. In this condition, bottom 70B of stack plate 70A is rotated by bias member 70G, about support shaft 70J and lifted up to the point where the uppermost recording medium 19 of the stack abuts against pickup roller 23. Note that the bias force of bias member 20G in this condition is set such that a pressure between the uppermost recording medium 19 and pickup roller 23 is suitable for feeding the uppermost recording medium with pickup roller 23.

Next, the operation shown in FIG. 15 will be described. In FIG. 15, the stack of recording media 19 is staked on stack plate 70A up to the maximum stacking capacity. Similarly to FIGS. 13 and 14, bottom 70B of stack plate 70A is rotated by bias member 70G, about support shaft 70J and lifted up to the point where the uppermost recording medium 19 of the stack abuts against pickup roller 23. Note that the bias force of bias member 20G in this condition is set such that a pressure between the uppermost recording medium 19 and pickup roller 23 is suitable for feeding the uppermost recording medium with pickup roller 23.

As described above, in order to place the stack of recording media in medium containing cassette 70 up to the maximum stacking capacity, stack plate 70A has to be pushed down to the bottom wall of container case 70I. Medium containing cassette 70 of the comparative example wherein the life-up mechanism to lift up stack plate 70A is provided in a moveable area of stack plate 70A, that is, bias member 70G for lifting up stack plate 70A is provided under stack plate 70A, thus has to have the bottom wall of container case 70I that is formed with seating portion 70Q for receiving bias member 70G therein. Further, seating portion 70Q of the bottom wall of container case 70I always receives forces from bias member 70G, and therefore seating portion 70Q of the bottom wall has to have a thickness more than a certain thickness to prevent a deformation of container case 70I such as due to creep.

If the lift-up mechanism for lifting up the stack plate was provided out of the moveable area of stack plate 70A, the medium containing cassette would be thinner. However, if the lift-up mechanism was provided out of the moveable area of stack plate 70A but on the widthwise outer position from the side wall of the medium containing cassette, the medium containing cassette would be bigger in the widthwise direction of the cassette that is perpendicular to the feeding direction. Contrasting to this, according to the first embodiment, a lift-up mechanism for lifting up stack plate 20A is provided on the downstream side in the feeding direction on the horizontal plane, that is, inside container case front portion 20L. With this configuration, the medium containing cassette can be smaller in the stacking direction as well as in the widthwise direction. Further, according to the first embodiment, the lift-up mechanism is provide in medium containing cassette 20 but is not provided in the body of image forming apparatus 1, therefore, the body of image forming apparatus 1 can be thinner.

Figure 16:
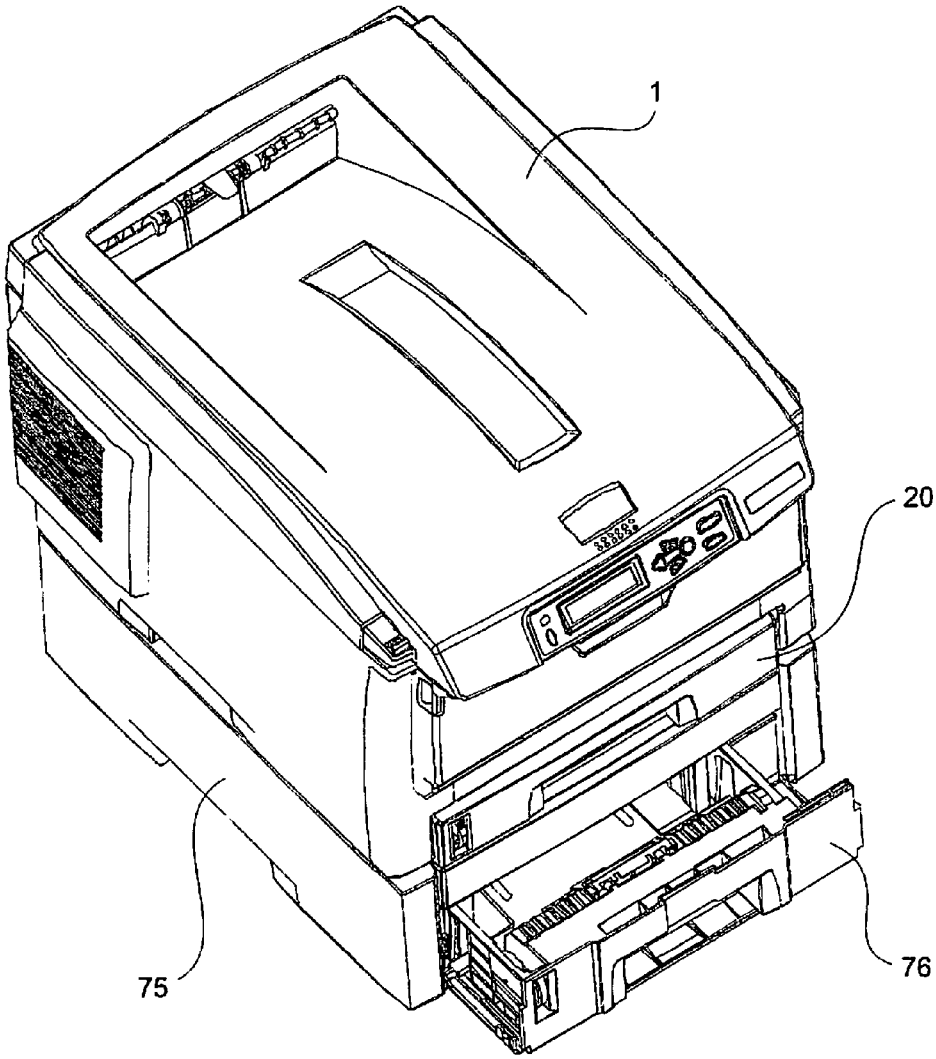
FIG. 16 is a perspective view of the image forming apparatus of the first embodiment with an optional medium feeding unit having a medium containing cassette.

Although the first embodiment describes medium containing cassette 20 that can be attached to the body of image forming apparatus 1, as shown in FIG. 16, an optional medium feeding unit 75 or an optional tray unit may have the medium containing cassette 76 that employs the configuration of medium containing cassette 20, without modifying the configuration and mechanisms of medium containing cassette 20.

According to the first embodiment, the lift-up mechanism for lifting up stack plate 20A is provided in container case front portion 20L of medium containing cassette 20 but not under stack plate 20A. This configuration significantly decreases the height of the medium containing cassette and significantly decreases the height and width of image forming apparatus 1 incorporating medium containing cassette 20 therein.

[Second Embodiment]

Next, image forming apparatus 1 according to a second embodiment will be described. The second embodiment has a lift-up mechanism for lifting up stack plate 100A that is formed of bias member 100G, such as a spring, and bias member 100R, such as a spring, and, other than that, image forming apparatus 1 of the second embodiment has the same configuration as that of the first embodiment. In the second embodiment, the description of the same configurations, operations, and effects as the first embodiment will be omitted, and configurations different from the first embodiment will be described.

Medium containing cassette 100 according to the second embodiment will be described in detail with reference to FIGS. 17 to 21.

Figure 17:
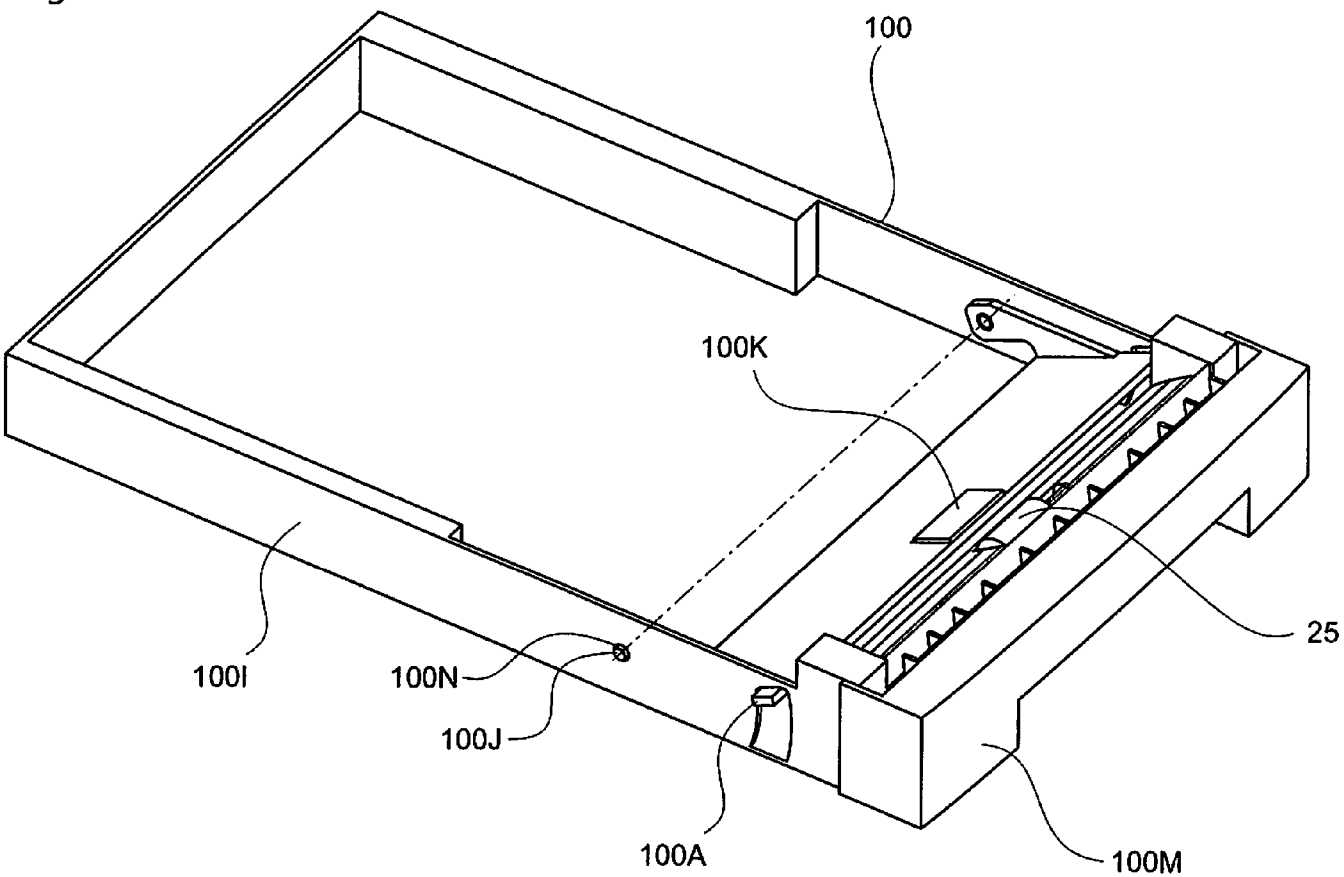
FIG. 17 is a perspective view of a medium containing cassette of a second embodiment.
Figure 18:
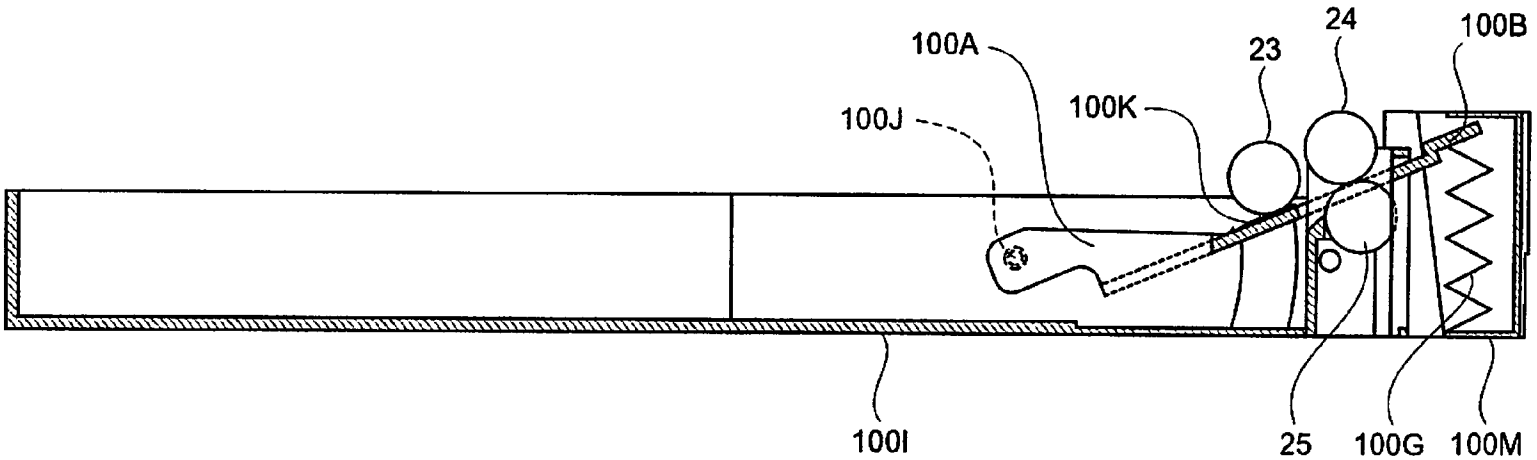
FIG. 18 is a perspective view of the medium containing cassette of the second embodiment.
Figure 19:
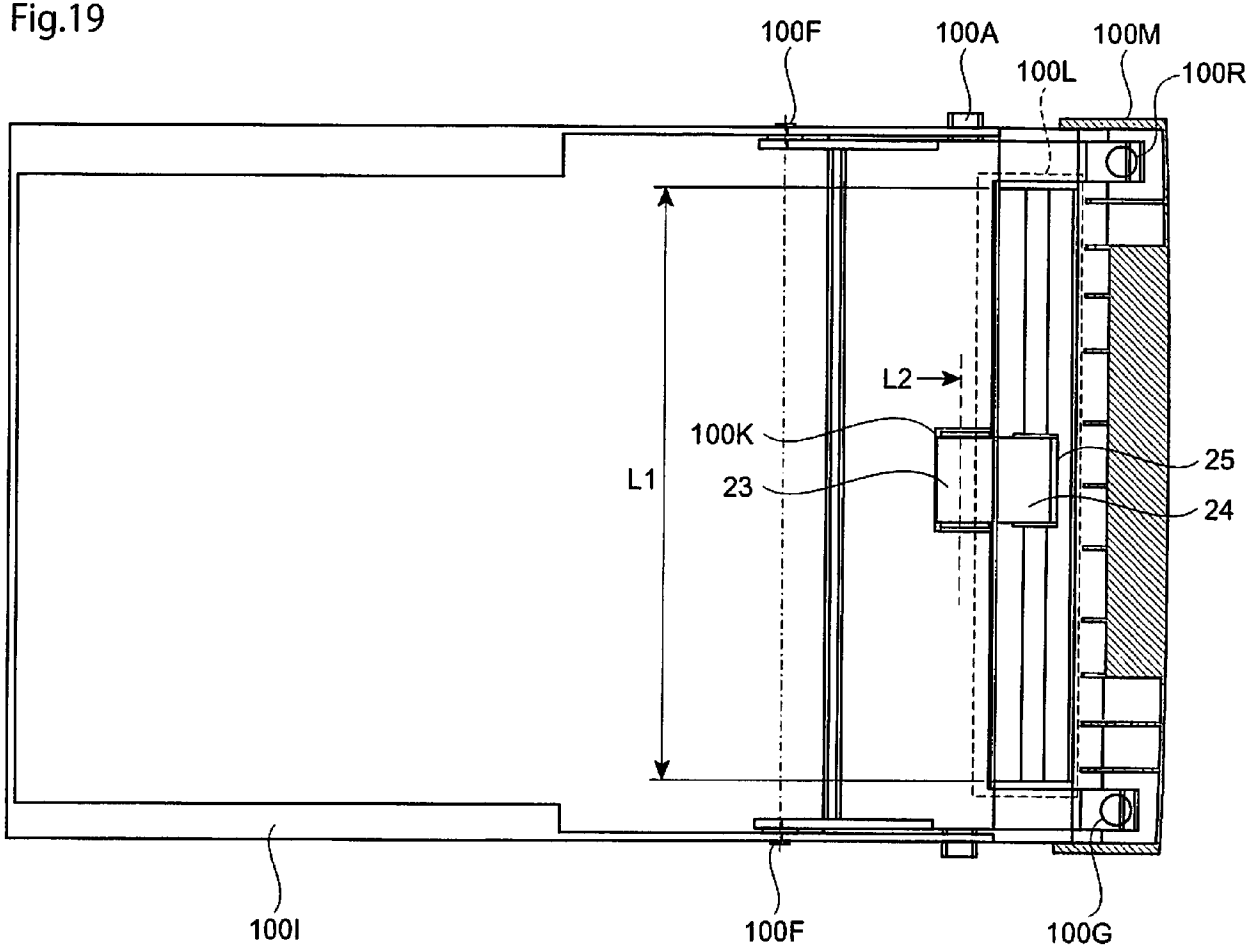
FIG. 19 is a top view of the medium containing cassette of the second embodiment.
Figure 20:
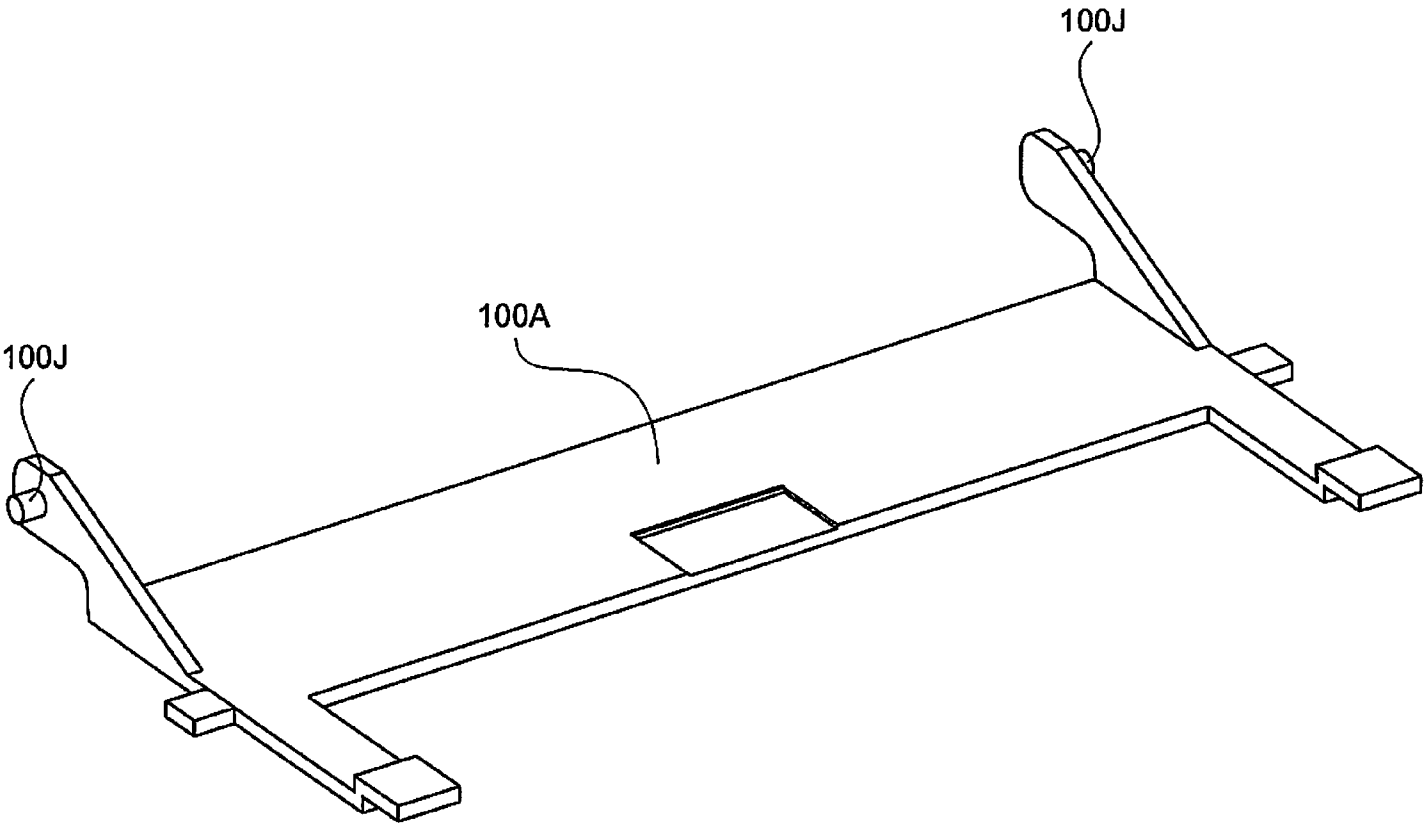
FIG. 20 is a perspective view of a stack plate of the second embodiment, as seen from the upper side.
Figure 21:
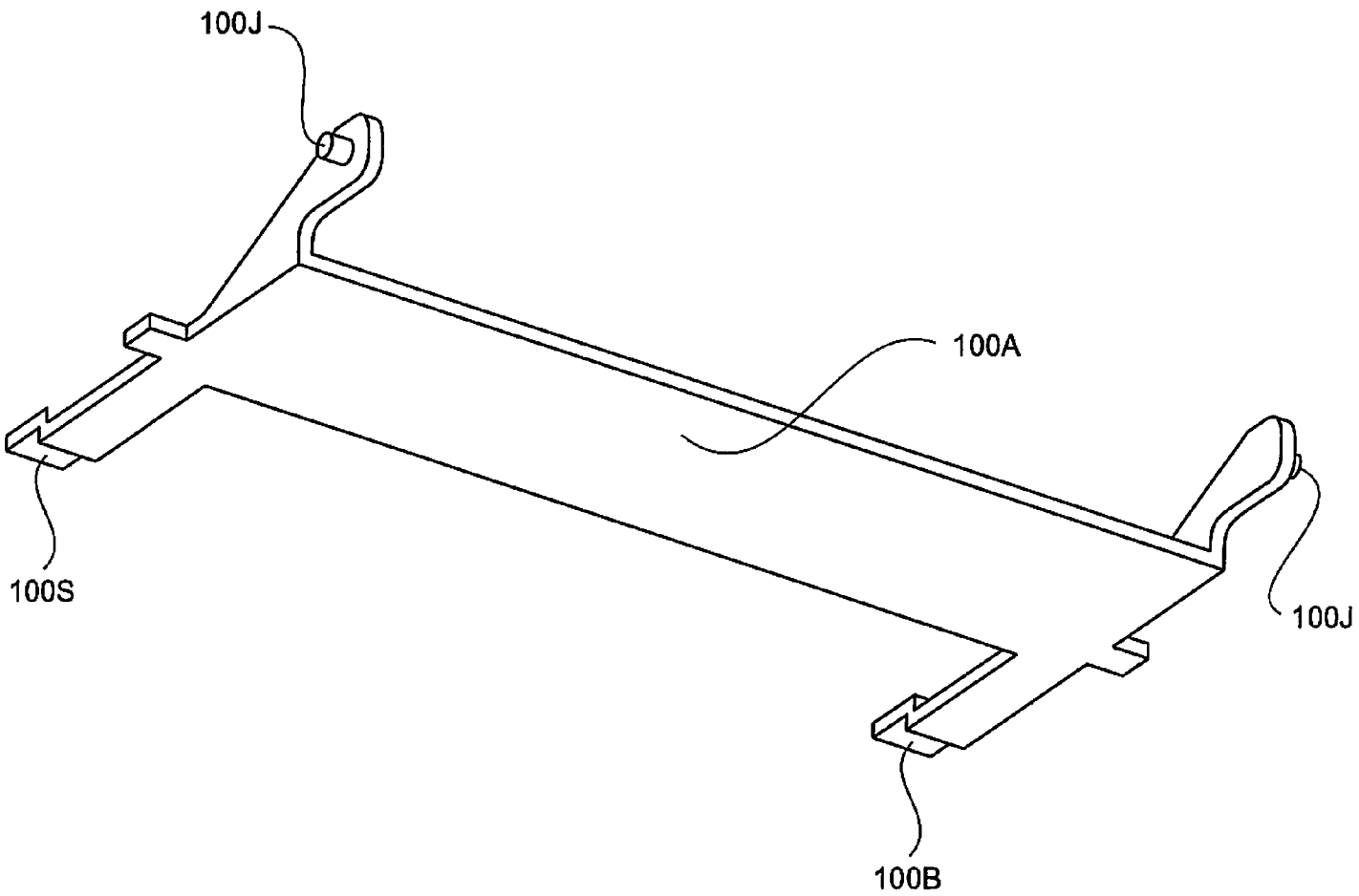
FIG. 21 is a perspective view of the stack plate of the second embodiment, as seen from the lower side.

Arrows X, Y, Z in FIG. 1 refer respectively to a direction from the front side to rear side, a direction from the bottom side to the upper side and a direction from the left side to the right side of medium containing cassette 20. FIG. 17 is a perspective view of medium containing cassette 100. FIG. 18 is a sectional view of medium containing cassette 100 as seen from the left side thereof. FIG. 19 is a top view of medium containing cassette 100 as seen from the upper side thereof. FIG. 20 is a perspective view of medium containing cassette 100 as seen from the bottom side thereof. Note that, in order to show a simplified positional configuration of the components of medium containing cassette 100, FIGS. 18 and 20 additionally show the positions of pickup roller 23 and feed roller 24 which are the components of medium feeding unit 21 provided in the body of image forming apparatus 1 but not the components of medium containing cassette 100, and FIGS. 18 and 20 do not show cassette cover 100M.

Medium containing cassette 100 is detachably attached to the body of image forming apparatus 1 and has container case 100I for containing therein the stack of recording media 19. Medium containing cassette 100 has stack plate 100A rotatably supported by supporting shaft 100J wherein recording media 19 are stacked on stack plate 100A. As shown in FIG. 19, the feeding side end (the front end) of stack plate 100A has arms serving as projections that extend to widthwise outer positions from a medium traveling area L1 or extend toward downstream side position in the feeding direction from medium feeding start point L2. The tips of the arm of stack plate 100A are disposed in cassette cover 100M that functions as a handle of medium containing cassette 100 for pulling medium containing cassette 100 out of the body of the image forming apparatus 1. Note that the bottom 100B of the tips of the left arm is biased to be lifted up by bias member 100G such as a spring and the bottom 100S of the tip of the right arm is biased to be lifted up by bias member 100R. When medium containing cassette 100 is not attached to the body of image forming apparatus 1, bottoms 100B and 100S are locked by the lift-up lock mechanism (not shown) at a predetermined position where bottoms 100B and 100S are pushed down. When medium containing cassette 100 is attached to the body of image forming apparatus 1, the lift-up lock mechanism is released by a lock release mechanism (not shown), so that bias members 100G and 100R bias to lift up bottoms 100B and 100S. With this, stack plate 100A and recording media 19 on the stack plate 100A are lifted up.

As shown in FIG. 17, medium containing cassette 100 has stack plate 100A for stacking recording media 19 at the front end (the feeding side end) of container case 100I. Stack plate 100A is formed with supporting shaft 100J rotatably supported by bearing holes 100F formed at the widthwise side walls of container case 100I. Friction pad 100K is provided on widthwise center portion of the front end (the feeding side end) of stack plate 100A. Friction pad 100K prevents the lowermost recording medium 19 from being fed with upper recording medium 19 when only a few recording media 19 remain. Fiction pad 100K is disposed such that the friction pad 100K is in press-contact with pickup roller 23 of medium feeding unit 21, when medium containing cassette 100 containing no recording media is attached to the body of image forming apparatus 1 and thereby stack plate 100A rotates about support shaft 100J to be lifted to the uppermost position. Container case front portion 100L is provided on the feeding side of container case 100I. Space above the container case front portion 100L is a conveying path through which recording media 19 contained in container case 100I will be conveyed by medium feeding unit 21 and the like without interfering with container case 100I. On the widthwise center portion of container case front portion 100L, retard roller 25 serving as a separator or a separating roller is provided such that retard roller 25 is biased against feed roller 24 of medium feeding unit 21 when medium containing cassette 100 is attached to the body of image forming apparatus 1. Retard roller 25 is biased upwardly by a spring (not shown) that is disposed under retard roller 25 and inside container case front portion 100L.

Container case front portion 100L has, at the widthwise outer portions from medium traveling area L1, hollows in which the arms of stack plate 100A can move up and down. Bottom 100B of the left arm and bottom 100S of the right arm are in contact with one ends of bias members 100G and 100R and biased by bias members 100G and 100R such that stack plate 100A is rotated about supporting shaft 100F. The other ends of bias members 100G and 100R is attached to the inside of cassette cover 100M. As shown in FIG. 19, bottom 100B of the left arm, bottom 100S of the right arm, bias member 100G and bias member 100R are disposed out of the medium traveling area so as not to interfere with retard roller 25 and the like provided at the widthwise center portion.

As described above, medium containing cassette 100 according to the second embodiment also has bias members 100G and 100R for lifting up stack plate 100A that is provided on the downstream side in the feeding direction from pickup roller 23, feed roller 24 and retard roller 25. With this configuration, bias members 100G and 100R do not overlap with the conveying path for recording media 19 so as to maintain a degree of freedom of a layout for bias members 100G and 100R even though the height of medium containing cassette 20 is limited. More specifically, the arms each have a crank shape such that the tip of the arm which is in contact with bias member 100G or 100R is a greater distance from the bottom wall of cassette cover 100M than the rest of the arm. With this, spaces having the heights of the compressed bias member 100G and 100R can be provided between the tips of the arms and the bottom wall of cassette cover 100M (see FIG. 26). Note that although the second embodiment describes medium containing cassette 100 that can be attached to the body of image forming apparatus 1, as shown in FIG. 16, an optional medium feeding unit 75 or an optional tray unit may have the medium containing cassette 76 that employs the configuration of medium containing cassette 100, without modifying the configuration and mechanisms of medium containing cassette 100.

Next, the operation inside medium containing cassette 100 will be described in detail. FIGS. 22 to 27 show the operation of stack plate 100A in medium containing cassette 100.

Figure 22:
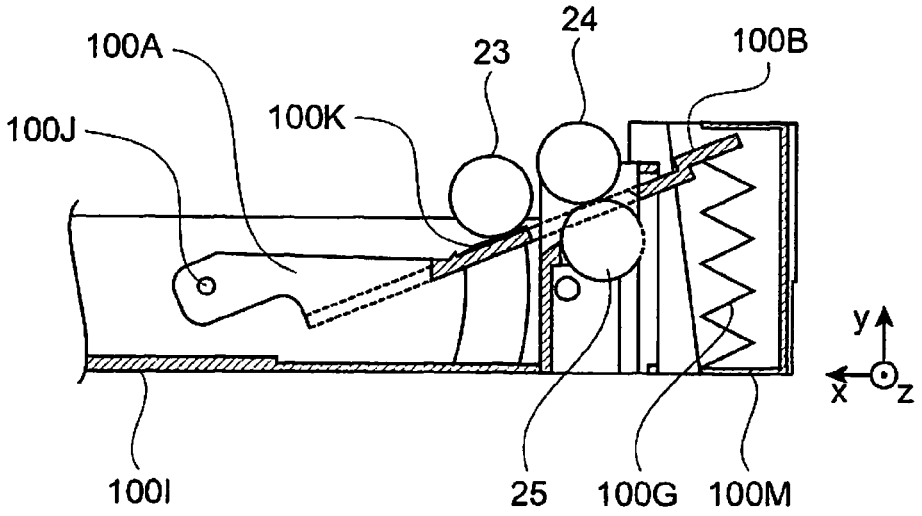
FIG. 22 is a sectional view of the medium containing cassette of the second embodiment, with no recording media stacked on the stack plate.
Figure 23:
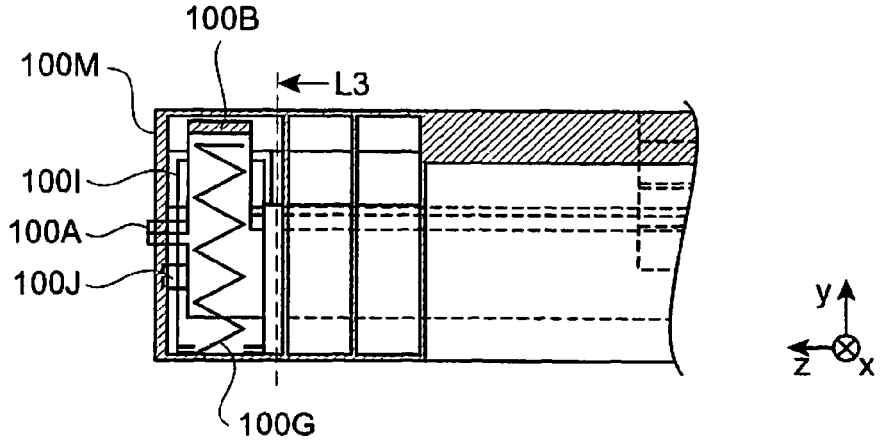
FIG. 23 is a sectional view of the medium containing cassette of the second embodiment, with no recording media stacked on the stack plate.
Figure 24:
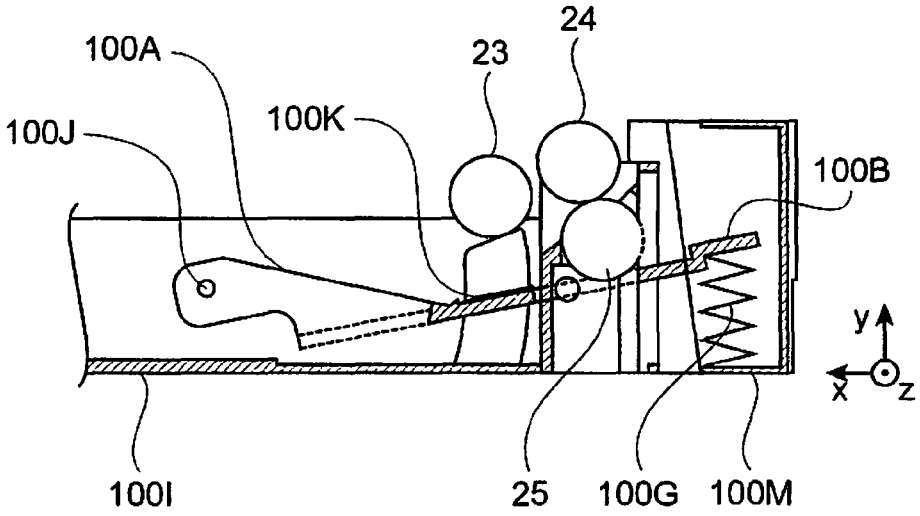
FIG. 24 is a sectional view of the medium containing cassette of the second embodiment, with some recording media stacked on the stack plate.
Figure 25:
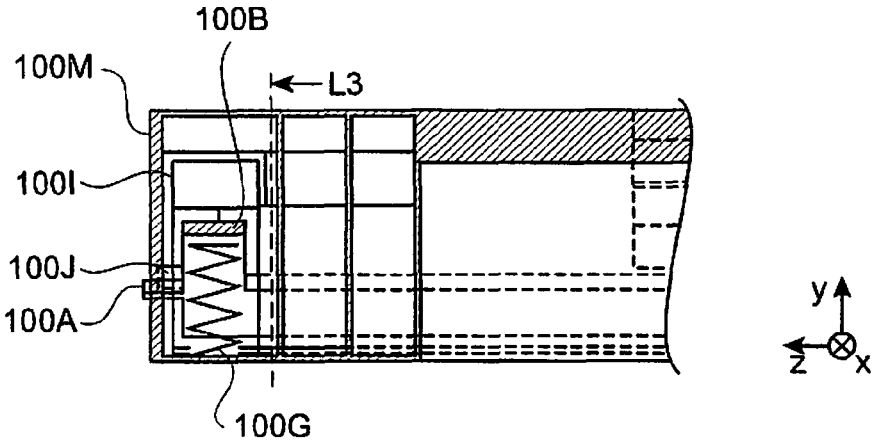
FIG. 25 is a sectional view of the medium containing cassette of the second embodiment, with some recording media stacked on the stack plate.
Figure 26:
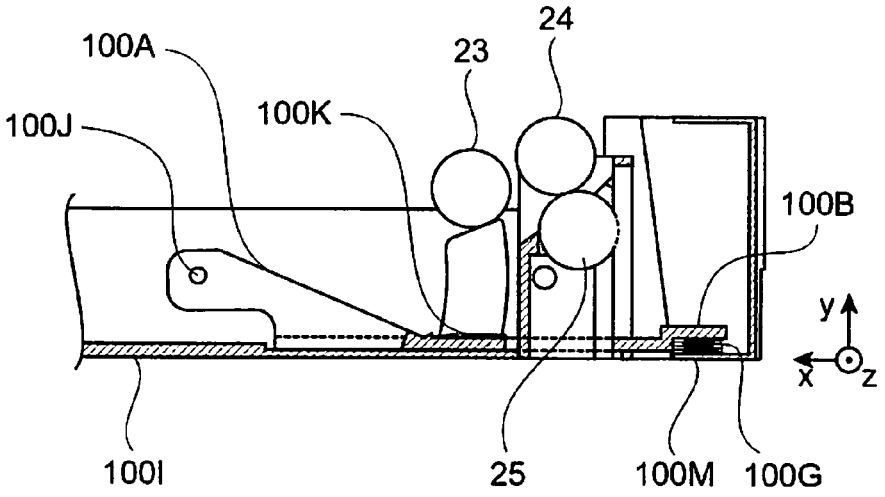
FIG. 26 is a sectional view of the medium containing cassette of the second embodiment, with recording media stacked on the stack plate to its maximum stacking capacity.
Figure 27:
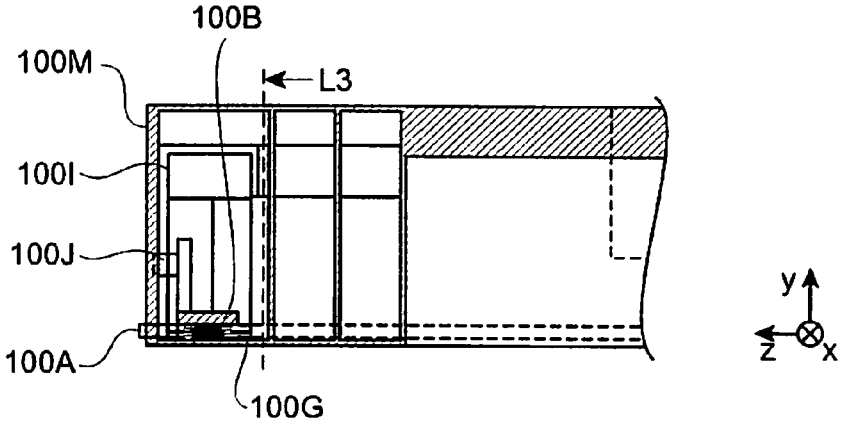
FIG. 27 is a sectional view of the medium containing cassette of the second embodiment, with recording media stacked on the stack plate to its maximum stacking capacity.

FIGS. 22 and 23 show a state where no recording media 19 are placed on stack plate 100A and thereby stack plate 100A is lifted to the position where stack plate 100A abuts against pickup roller 23. FIGS. 24 and 25 show a state where the stack of recording media 19 is stacked on stack plate 100A nearly to half of the maximum capacity of medium containing cassette 100. FIGS. 26 and 27 show a state where the stack of recording media 19 is stacked on stack plate 100A up to the maximum capacity of medium containing cassette 100. FIGS. 22, 24 and 26 are sectional views of medium containing cassette 100 as seen from the left side thereof, and FIGS. 23, 25 and 27 are sectional views of medium containing cassette 100 as seen from the front side thereof. In FIGS. 23, 25 and 27, symbol L3 denotes the media traveling area. Note that, FIGS. 23 to 27 show a state where medium containing cassette 100 is attached to the body of image forming apparatus 1 having the medium feeding mechanism. First, the operation inside medium containing cassette 20 will be briefly described, and then, the operation shown in FIGS. 22 and 23, the operation shown in FIGS. 24 and 25, and the operation shown in FIGS. 26 and 27 will be described in order.

First, the operation inside medium containing cassette 100 will be described briefly. Bottoms 100B and 100S which are the tips of the arms are biased by bias members 100G and 100R that are provided in cassette cover 100M, so that stack plate 20A is rotated up. Stack plate 100A that is lifted by bottoms 100B and 100S of the arms is rotated about supporting shaft 100J parallel to the axis Z and extending through bearing hole 100N provided the side walls of container case 100I, so that friction pad 100K provided on stack plate 100A moves toward pickup roller 23.

Next, the operation shown in FIGS. 22 and 23 will be described. FIGS. 22 and 23 show the state where no recording media 19 are stacked on stack plate 100A. In this state, bottoms 100B and 100S of stack plate 100A are lifted up by bias forces of bias members 100G and 100R, and stack plate 100A is rotated about supporting shaft 100J to the position where friction pad 100*k* of stack plate 100A abuts against pickup roller 23. In this state, pickup roller 23 can be driven to rotate, but other movements are restricted.

Next, the operation shown in FIGS. 24 and 25 will be described. FIGS. 24 and 25 show the state where the stack of recording media 19 is stacked on stack plate 100A nearly to half of the maximum stacking capacity. In this state, bottoms 100B and 100S of stack plate 100A are lifted up by bias members 100G and 100R, and stack plate 100A is rotated about supporting shaft 100J to the position where the uppermost recording medium of the stack abuts against pickup roller 23. Note that the bias forces of bias members 100G and 100R in this position are set such that a pressure between the uppermost recording medium 19 and pickup roller 23 is suitable for feeding the uppermost recording medium with pickup roller 23.

Next, the operation shown in FIGS. 26 and 27 will be described. FIGS. 26 and 27 show the state where the stack of recording media 19 is stacked on stack plate 100A up to the maximum stacking capacity. In this state, similar to FIGS. 22 to 25, bottoms 100B and 100S of stack plate 100A are lifted up by bias members 100G and 100R, and stack plate 100A is rotated about supporting shaft 100J to the position where the uppermost recording medium of the stack abuts against pickup roller 23. Note that the bias forces of bias members 100G and 100R in this position are set such that a pressure between the uppermost recording medium 19 and pickup roller 23 is suitable for feeding the uppermost recording medium by with pickup roller 23.

Note that since lift-up operation of stack plate 100A occurs in medium containing cassette 100, recording media 19 move toward the medium feeding mechanism for feeding recording media appropriately after medium containing cassette 20 is attached to the body of image forming apparatus 1, regardless of the amount of recording media stacked in medium containing cassette 20.

As described above, the second embodiment has a mechanism for lifting stack plate 100A which is simpler and less expensive than that of medium containing cassette 20 of the first embodiment, having only bias members 100G and 100R such as a spring. Further, according to the second embodiment, the position where stack plate 100A is lifted up is disposed at a position on the downstream side in the feeding direction from the medium stack position. With this, the bias force to lift up stack plate 100A can be smaller. Furthermore, the second embodiment significantly decreases the height of medium containing cassette 100 and also significantly decreases the height and width of image forming apparatus 1 incorporating medium containing cassette 20 therein.

Although the above embodiments describes image forming apparatus 1 which is a printer, image forming apparatus 1 of the above embodiments can also be applied to a copy machine, a facsimile machine, a scanning machine, a multifunction printer (MFP) or the like. Although the above embodiments describe a method of feeding recording medium 19 from medium containing cassette 20 or medium containing cassette 100 which are attached to image forming apparatus 1, the above embodiments may employ a different feeding method such as a feeding method of feeding recording medium 19 from medium containing cassette or paper cassette incorporated in an optional tray unit, and can achieve the same effects as or similar effects to the above embodiments. In the above embodiments, a separator for separating the stack of recording media contained in medium containing cassette 20 or medium containing cassette 100 into one by one is a retard roller serving as a separating roller (that is, a retard roller type separator), the separator may have a different configuration such as a friction pad serving as a separating lip (that is, a lip type separator) or the like, and this can achieve the same effects as or similar effects to the above embodiments. Image forming unit 2 according to the above embodiments includes four image forming units 2C, 2M, 2Y and 2K which form toner images of black, yellow, magenta and cyan, respectively, however, mage forming unit 2 may includes three image forming unit 2C, 2M and 2Y without black one, or image forming unit 2 may includes two image forming units 2K for forming black toner image. The invention thus does not limit the number of image forming unit 2, a color combination of image forming unit 2, a layout of image forming unit 2 or the like.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A medium containing cassette comprising:

a container case for containing media;

a stack plate movable in the container case and configured to stack the media thereon;

a separator provided on the container case and configured to separate the media one by one;

a feeding roller which is opposed to the separator across a medium conveying path through which the medium is conveyed;

a bias member configured to bias the stack plate in a direction toward the media stacked on the stack plate, a projection extending from the stack plate and being in contact with the bias member such that the stack plate is biased by the bias member via the projection, wherein the bias member is disposed such that the distance between the bias member and the stack plate is greater than the distance between the stack plate and the separator in a direction along a plane substantially perpendicular to a bias direction of the bias member;

wherein the projection extends in the direction from the stack plate to the separator, wherein the projection is provided at each widthwise end portion of the stack plate and extends in a longitudinal direction of the container case, such that the feeding roller is provided between the projections in the widthwise direction of the stack plate, and wherein the projection s and the stack plate form a unitary, single-piece structure.

2. The medium containing cassette according to claim 1 wherein the separator is a separating lip.

3. The medium containing cassette according to claim 1 wherein the separator is a separating roller.

4. The medium containing cassette according to claim 1, wherein the projections are disposed at a position out of the separator, as seen along the bias direction of the bias member.

5. The medium containing cassette according to claim 1, wherein the projection has a body and a tip thereof which abuts against one end of the bias member, the container case has a seating surface on which the other end of the bias member is attached, and the projection is formed in a crank shape such that the tip of the projection has a greater distance from the seating surface than the body of the projection, having a height of the bias member when the bias member is completely compressed.

6. A medium feeding unit incorporating therein the medium containing cassette of claim 1.

7. The medium feeding unit according to claim 6, further comprising a pickup roller toward which the stack of media on the stack plate is biased and against which the stack plate is abutted by the bias force of the bias member; and a medium conveying member configured to convey the medium that has been separated by the separator.

8. An image forming apparatus comprising the medium feeding unit of claim 7.

9. The image forming apparatus according to claim 8, further comprising an image forming unit configured to form a toner image according to image data;

a transfer unit configured to transfer the toner image from the image forming unit onto media fed through the medium conveying path from the medium containing cassette; and a fixing unit configured to fix the toner image onto the media.

10. An optional medium feeding unit incorporating therein the medium containing cassette of claim 1.

11. The optional medium feeding unit according to claim 10, further comprising a pickup roller toward which the stack of media on the stack plate is biased and against which the stack plate is abutted by the bias force of the bias member; and a medium conveying member configured to convey the medium that has been separated by the separator.

12. An image forming apparatus comprising the optional medium feeding unit of claim 11.

13. The image forming apparatus according to claim 12, further comprising an image forming unit configured to form a toner image according to image data;

a transfer unit configured to transfer the toner image from the image forming unit onto media fed through the medium conveying path from the medium containing cassette; and a fixing unit configured to fix the toner image onto the media.

14. A medium containing cassette comprising:

a container case including a medium stacking space to contain a stack of media and a handle portion configured to be grabbed to draw the container case;

a stack plate movable in the container case and configured to stack the media thereon;

a bias member configured to bias the stack plate in a direction toward the media stacked on the stack plate, a feeding roller which is opposed to a separator across a medium conveying path through which the medium is conveyed;

a projection extending from the stack plate and being in contact with the bias member such that the stack plate is biased by the bias member via the projection, wherein the bias member is disposed inside the handle portion, and wherein the projection is provided at each widthwise end portion of the stack plate and extends in a longitudinal direction of the container case, such that the feeding roller is provided between the projections in the widthwise direction of the stack plate.

* * * * *